US006554638B1

(12) United States Patent
Hess et al.

(10) Patent No.: US 6,554,638 B1
(45) **Date of Patent: *Apr. 29, 2003**

(54) MODULAR ELECTRICAL CONNECTOR ASSEMBLIES WITH MAGNETIC FILTER AND/OR VISUAL INDICATOR

(75) Inventors: John Hess, Dallastown, PA (US); Derek Imschweiler, Dallastown, PA (US); Jeffrey Wallace Fleming, York, PA (US); Patrick Hulbert, New Providence, PA (US); Ronald Janz, York, PA (US); David Givens, Red Lion, PA (US); Ronald Locati, York, PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/417,644

(22) Filed: Oct. 14, 1999

Related U.S. Application Data

(60) Provisional application No. 60/104,137, filed on Oct. 14, 1998.

(51) Int. Cl.[7] ..... H01R 3/00

(52) U.S. Cl. ..... 439/490; 439/676

(58) Field of Search ..... 439/490, 676, 439/607, 620

(56) References Cited

U.S. PATENT DOCUMENTS 4,397,513 A * 8/1983 Clark et al. ..... 439/490
4,547,840 A * 10/1985 Tinder ..... 362/226
5,069,641 A * 12/1991 Sakamoto et al. ..... 439/620
5,599,209 A * 2/1997 Belopolsky ..... 439/676
5,736,910 A * 4/1998 Townsend et al. ..... 333/181
5,741,152 A * 4/1998 Boutros ..... 439/490
5,797,767 A * 8/1998 Schell ..... 439/490
5,876,239 A * 3/1999 Morin et al. ..... 439/490
5,885,100 A 3/1999 Talend et al. ..... 439/490
5,915,993 A * 6/1999 Belopolsky et al. ..... 439/490
5,957,730 A * 9/1999 Wang ..... 439/676
6,012,953 A 1/2000 Francis ..... 439/676
6,095,851 A * 8/2000 Laity et al. ..... 439/490
6,224,417 B1 * 5/2001 Belopolsky et al. ..... 439/490

* cited by examiner

*Primary Examiner*—Javaid Nasri
(74) *Attorney, Agent, or Firm*—Steinberg & Baskin, P.C.

(57) ABSTRACT

A connector assembly for mounting on a main printed circuit board, comprising a jack defining a plug-receiving receptacle and including an outer housing part and an inner housing part, circuit coupling means including contact portions arranged in said receptacle and adapted to engage contacts of a mating plug when situated in said receptacle and terminal portions adapted to engage the main printed circuit board and being electrically coupled to said contact portions, a light pipe element arranged in said jack being visible from a front face of said jack, and light generating means for generating light and being arranged such that light generated by said light generating means is transmitted through said at least one light transmitting section to said front face of said jack. The circuit coupling means further comprising an internal printed circuit board arranged in said jack and including filtering components mounted thereon, said internal printed circuit board including a wiring pattern for electrically coupling a first set of contacts, a second set of contacts and filtering components together.

7 Claims, 20 Drawing Sheets

128
P1
18b
130
126
68
18c1
P2
114
68a
18c2
108
18c
14
18a
18
104
70
94

FIG.26
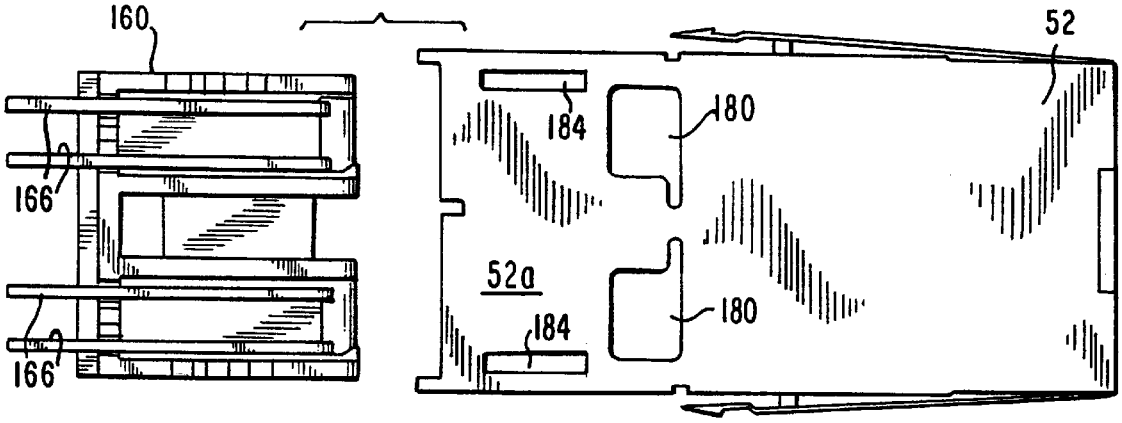
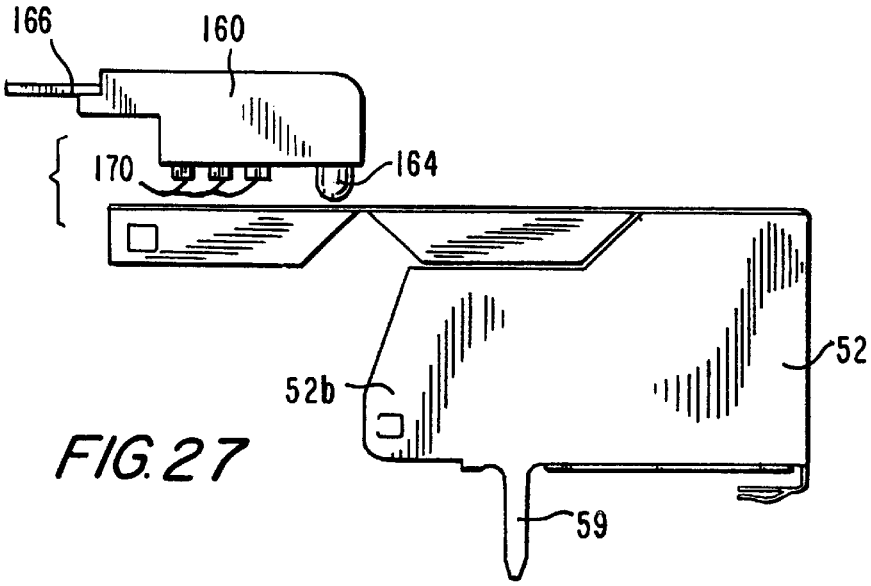
FIG.27
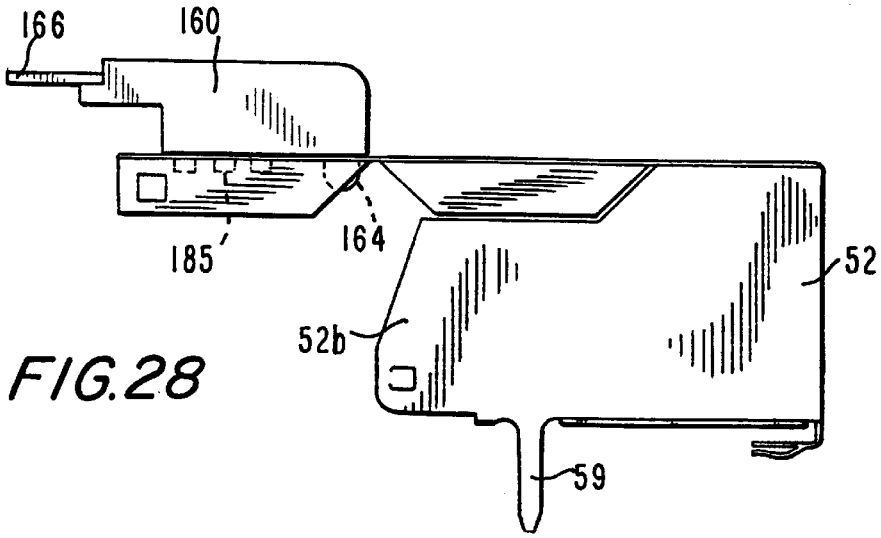
FIG.28

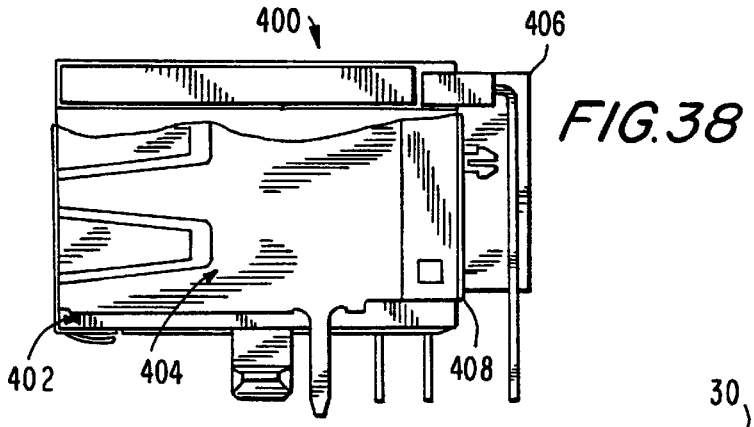
FIG. 38
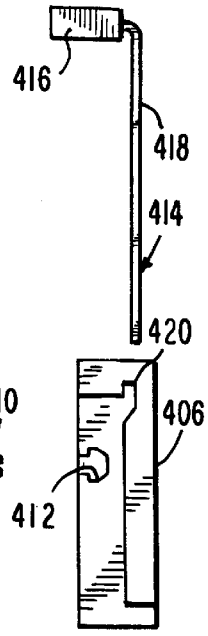
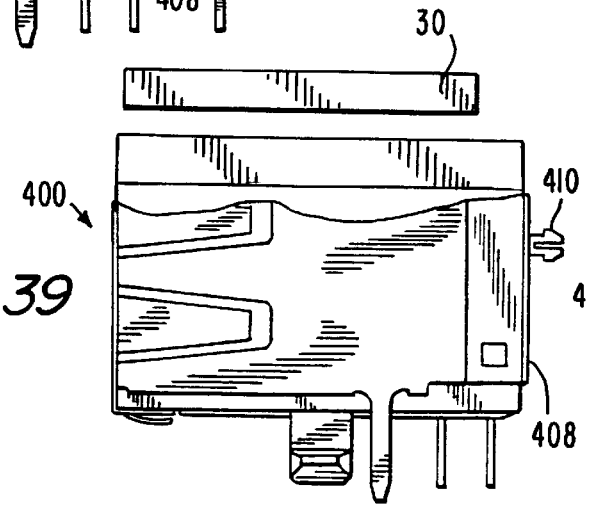
FIG. 39
FIG. 40
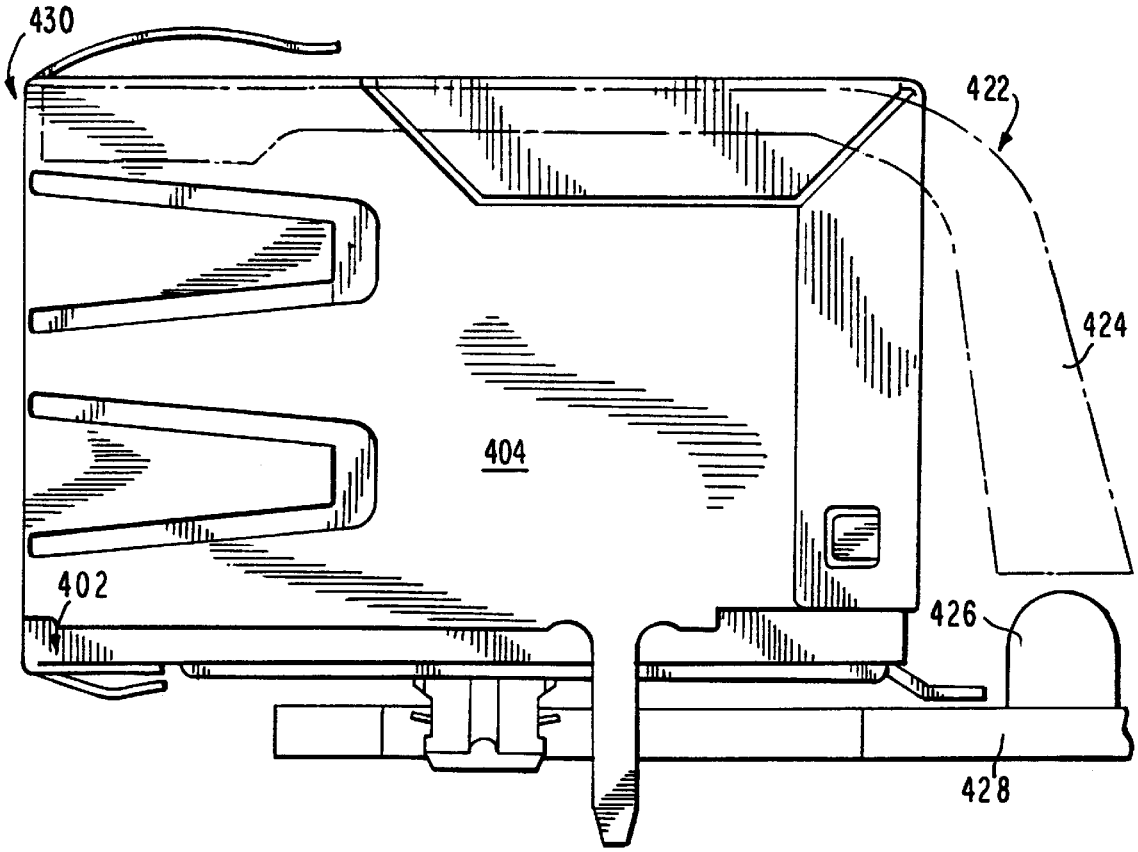

MODULAR ELECTRICAL CONNECTOR ASSEMBLIES WITH MAGNETIC FILTER AND/OR VISUAL INDICATOR

CROSS-REFERENCE TO RELATED APPLICATION

This application claims priority under 35 U.S.C. §119(e) of U.S. provisional patent application Serial No. 60/104,137 filed Oct. 14, 1998.

FIELD OF THE INVENTION

This invention relates generally to modular electrical connector assemblies including light emitting means for indicating electrical coupling with the connector assembly and more specifically, to modular jacks receivable of mating plugs and having associated visual indicators for indicating coupling of a mating plug to the jack.

The present invention also relates to modular electrical connector assemblies including magnetic components for filtering common mode and differential mode interference and for eliminating high frequency noise.

The present invention also relates to modular electrical connector assemblies including both light emitting means and magnetic filtering components.

BACKGROUND OF THE INVENTION

Modular jack connectors or connector assemblies are well known in the telecommunications industry and have been adapted for mounting to printed circuit boards. These connector assemblies are typically used for electrical connection between two electrical communication devices. In order to ensure that a proper connection has been made and therefore a link is created between the electrical communication devices, indicators are often incorporated into circuits on the printed circuit board. These indicators are typically light emitting diodes (LEDs) which are turned on when a circuit is completed between the mating connector assemblies and the communication devices. Additionally, LEDs can be mounted on the printed circuit board to indicate a number of other conditions including the passage of communications signals between the two communication devices, indication of power, or indication that an error in transmitting the signals has occurred. Thus, LEDs provide an easy visual reference for enabling the tester of a circuit card to test the operation of circuits on the card as well as providing a status indicator during normal operation of the card.

In an effort to miniaturize printed circuit boards and increase the available space on the printed circuit board, visual indicators have been integrated into these connector assemblies. An example of such a connector assembly is disclosed in U.S. Pat. No. 4,978,317 to Pocrass which describes a connector assembly for receiving a plug having a visual indicator positioned within the front wall of the electrical connector housing. Incorporation of the indicator into the electrical connector eliminates the need for a separate location on the printed circuit board for mounting of such an indicator. The LED indicator is inserted into a recess of the housing of the electrical connector such that its electrical leads pass through a wall of the housing and connect to the printed circuit board. The indicator is then cemented into the recess or attached to the housing using an appropriate adhesive. The LEDs may also be molded into the electrical connector during the molding process of the housing.

A problem arises with these connector assemblies in that because the anode and cathode leads of the LED are side by side confusion and misconnection can result prior to board mounting. It is also desirable to eliminate the need for securing the LEDs in the housing by cementing or attaching with an adhesive.

Another problem arises in that in the LEDs are situated at the front of the connector assembly, in the narrow space between the mating connector opening and the top or bottom and sides of the connector assembly. Since the connector assemblies, typically telephone jack or "RJ"-type connector assemblies, are generally limited to predetermined dimensions, and because these connector assemblies were not initially designed to accommodate lights or other components at the front of the connector assembly, the available space is very small, and thus the LEDs are also limited in size and power. In addition, the placement of the LEDs at the front of the connector assembly presents the problem that the lead wires for the LEDs must be run through the connector assembly and bent at a ninety degree angle in order to reach the circuit board to which they are to be connected, making installation of the lights in the connector assembly difficult.

Another example of a connector assembly including an indicator light is U.S. Pat. No. 5,601,451 to Driones et al. Driones et al. shows a connector assembly having LEDs situated in openings within the stepped portion of a modular jack interior profile (FIGS. 5 and 6). Shoulders are provided to hold the LEDs in place, i.e., they are constructed to enable insertion of the LEDs through the front face of the housing while preventing removal of the LEDs through the bottom surface of the connector assembly.

Further, U.S. Pat. No. 5,613,873 to Bell, Jr. shows a modular jack having a recess in a front face for receiving a light-emitting portion of an LED whereby conductor wires of the LED are passed through passageways in the jack housing to the rear of the housing and then bent downward for connection to a printed circuit board (FIGS. 1–4). In additional embodiments shown in FIGS. 5–12, the LEDs are situated at a rear of the housing and the housing is made of transparent or translucent plastic resin.

U.S. Pat. No. 5,685,737 to Morin et al. shows a modular jack which has LEDs in exteriorly facing recesses in a bottom wall of the housing. The LEDs have guide recesses which cooperate with guide projections situated at the sides of the recesses.

U.S. Pat. No. 5,700,157 to Chung shows a modular jack with LEDs mounted in a recess in the front face whereby each LED is connected via a terminal to a printed circuit board.

U.S. Pat. No. 5,704,802 to Loudermilk shows a modular jack having a two-part housing having a shell and a rear insert and includes three LEDs, each positioned in a chamber at the front of the shell and having conductor leads connected thereto which extend through a lead chamber to the rear of the shell. The conductor leads engage leads of conductors of a lead frame which are situated in the rear insert.

U.S. Pat. No. 5,741,152 to Boutros shows a modular jack having a light guide for conveying light from an LED situated at a rear of the housing.

U.S. Pat. No. 5,775,946 to Briones shows a multi-port connector assembly having LEDs spaced from the printed circuit board to which the connector assembly is mounted and arranged in rearwardly facing cavities in the front wall of the connector assembly (see FIGS. 6 and 8). Leads from the LEDs extend rearwardly and downwardly through recesses for connection to the printed circuit board (See FIG. 6).

U.S. Pat. No. 5,797,767 to Schell shows three embodiments of a modular jack with an indicator light. In a first embodiment shown in FIG. 1, the jack includes a front shield or face plate adapted to be removably or detachably received against a front wall of the jack. The face plate includes brackets having bores through which LEDs are inserted. The brackets correspond in location to cutout areas of the housing of the jack. Leads extend from the LEDs rearwardly and downwardly for connection to a printed circuit board. In a second embodiment shown in FIG. 2, the face plate includes brackets corresponding in location to the cutout areas of the housing of the jack and having one or more notches for providing a seat for LEDs. To this end, the body of the LEDs includes a groove receivable of the notch. Leads extend from the LEDs rearwardly and downwardly for connection to a printed circuit board. In a third embodiment shown in FIGS. 3 and 4, the face plate includes LEDs mounted to the upper portion thereof. The LEDs are electrically coupled to an end of a flexible conductor strip. The conductor strip is contiguous with the top wall of the housing and is electrically coupled to terminal pins that are in turn electrically coupled to circuits on the printed circuit board to which the connector assembly is mounted. A lens overlies the LEDs and softens the LED light effect.

U.S. Pat. No. 5,790,041 to Lee shows a modular jack having an opening situated in a bottom wall defining the plug-receiving cavity and which is positioned above an LED mounted on the printed circuit board to which the jack is mounted (see, e.g., FIG. 3A). Upon insertion of a plug into the cavity in the jack, the LED emits light which passes through the opening and through the transparent part of the plug to provide a visual indication of the status of the connection.

For the most part, in the prior art discussed above, the LEDs are arranged within the housing of the jack. Depending on the particular construction of the jack, the size of the LEDs would be limited in view of the specific dimensional requirements of RJ-type modular jacks. Moreover, since LEDs generate a significant amount of electrical noise, the proximity of the LEDs to the contact members in the jacks could adversely affect the data transmission.

Electrical devices are frequently subject to adverse operation in the presence of radio frequency interference in the electrical lines connecting the devices to, e.g., data communication lines. The electrical devices are not only susceptible to such interference, they also function as a source of such interference. Filters must therefore be interposed between connected electrical devices to screen out the interference and minimize its effect on the operation of the electrical devices.

This interference may cause two types of distortion of the power circuit wave form, viz., common mode interference where identical wave forms are impressed on the electrical lines connecting the electrical devices, and differential mode interference which appears as a voltage difference between the connecting electrical lines. Circuitry exists to filter radio frequency interference, but for optimum effectiveness and cost, it has been found to be more efficient to treat the two types of interference independently, i.e., to provide one group of electrical components to serve as a common mode filter and another group of electrical components to serve as a differential mode filter.

Since electrical devices are often coupled by modular jack connector assemblies, it is desirable to construct modular jack connector assemblies with integral magnetic filter components to avoid the need for additional, external filter components.

One such connector assembly is described in U.S. Pat. No. 5,736,910 (Townsend et al.). Townsend et al. describes a modular jack connector assembly mounted on a main printed circuit board and having a receptacle into which a modular plug of an electronic component is inserted. The connector assembly includes a housing, a first set of contacts arranged in the housing each adapted to engage one of the contacts of the plug, a second set of contacts at least partially arranged in the housing and adapted to engaging the main printed circuit board, contact coupling circuit means for electrically coupling the first and second sets of contacts, a capacitor for providing impedance to high frequency noise and interference and a metallic shield at least partially surrounding the housing and connected to a grounding region on the main printed circuit board. The contact coupling circuit means include the filtering components which is one embodiment are toroidal coil pairs which function separately as either a differential mode filter or a common mode filter. The entire disclosure of Townsend et al. is incorporated by reference herein.

In the prior art discussed above, there is no electrical connector assembly including both a visual indicator and magnetic filtering components.

OBJECTS OF THE INVENTION

Accordingly, it is an object of the present invention to provide new and improved modular connector assemblies including both a visual indicator and magnetic filtering components.

Another object of the present invention is to provide new and improved modular connector assemblies incorporating visual indicators and optional magnetic filtering components.

Still another object of the present invention is to provide new and improved modular connector assemblies including magnetic filtering components and optional visual indicators.

It is still another object of the present invention to provide new and improved modular connector assemblies including a housing capable of being surface mounted or through mounted to a printed circuit board depending on the contact members arranged in the housing.

SUMMARY OF THE INVENTION

In order to achieve at least some of the objects mentioned above and others, one embodiment of a connector assembly for mounting on a main printed circuit board comprises a light pipe element arranged in a jack and comprising at least one light transmitting section arranged such that each light transmitting section is visible from a front face of the jack, and light generating means for generating light upon proper mating of a plug in a receptacle defined by the jack. The light generating means are arranged at a rear of the jack, and possibly even partially outside of a shield surrounding the jack, and generate light which is transmitted through the light transmitting section(s) to the front face of the jack. Thus, the light generating means, e.g., an LED, is not adjacent the front face of the jack and when situated outside of the jack, its dimensions are not limited by the size of the jack.

The jack is constructed to allow for either surface-mounting to a printed circuit board or through-hole-mounting to a printed circuit board. The jack includes an outer housing part and an inner housing part and circuit coupling means including contact portions arranged in the receptacle and adapted to engage contacts of a mating plug when situated in the receptacle and terminal portions adapted to engage the main printed circuit board and electrically coupled to the contact portions. The outer housing part has a pair of stepped portions and includes a channel in each stepped portion whereby a light transmitting section may be arranged in each channel.

The connector assembly may also comprise a shield arranged over the jack whereby the light generating means are situated at least partially exterior of the jack and the shield. For example, an LED holder may be arranged exterior of and connected to the shield and the light generating means arranged on the LED holder. In this case, the light generating means may comprise at least one LED assembly, each including an LED bulb and a pair of contacts adapted to engage the main printed circuit board. The LED bulb(s) extend through a respective aperture formed in a rear face of the shield and are arranged to be in alignment with a respective light transmitting section of the light pipe element. To attach the LED holder to the shield, the shield may comprise one or more mounting posts and the LED holder includes complementary surfaces to receive the mounting post(s).

The circuit coupling means may comprise an internal printed circuit board arranged in a cavity in the inner housing part and including optional filtering components mounted thereon, a first set of contacts including the contact portions and a board portion connected to the internal printed circuit board, and a second set of contacts connected to the internal printed circuit board and including the terminal portions. The internal printed circuit board includes a wiring pattern for electrically coupling the first set of contacts, the second set of contacts and the optional filtering components. Also, the light generating means, if present, may be arranged on the internal printed circuit board whereby the wiring pattern in the internal printed circuit board is arranged to electrically couple the same to some of the contacts in the second set of contacts.

Another embodiment of a connector assembly for mounting on a main printed circuit board comprises a jack defining a plug-receiving receptacle and including an outer housing part and an inner housing part, contact members arranged in the jack, each having a contact portion situated in the receptacle, a terminal portion extending from the jack and adapted to be connected to the main printed circuit board, and an intermediate bridging portion connecting the contact portion to the terminal portion. In accordance with the invention, the bridging portion has a first surface abutting at least at a first location against a surface of one of the inner and outer housing part and a second surface opposite to the first surface abutting at least at a second location against a surface of the other of the inner and outer housing part. In this manner, an angle of extension of the terminal portion from the jack is determined by the first and second locations of the abutting first and second surfaces of the bridging portion and the inner and outer housing parts. The terminal portions can thus be made substantially co-planar.

Another embodiment of a connector assembly for mounting on a main printed circuit board comprises a jack defining a plug-receiving receptacle and including an outer housing part and an inner housing part. The outer housing part comprises a top wall including a cavity adjacent each side wall. When used with a light pipe element described above, the light transmitting section(s) of the light pipe element may have a greater cross-sectional area at a rear of the jack occupying a respective cavity than adjacent the front face of the jack and thereby increase the efficiency of the transmission of light through the light pipe element.

Another embodiment of a connector assembly for mounting on a main printed circuit board, which is designed for enabling either surface-mounting or through-hole mounting to a printed circuit board, comprises a jack including an inner housing part comprising a front, flat portion, a vertical wall extending perpendicular to the front portion and a rear portion extending rearward from the vertical wall and defining a cavity. Circuit coupling means are provided and in a preferred embodiment, include an internal printed circuit board arranged in the cavity in the rear portion of the inner housing part, a first set of contacts arranged in the jack and including contact portions arranged in the receptacle, and a second set of contacts connected to the internal printed circuit board and including terminal portions adapted to engage the main printed circuit board. The internal printed circuit board includes a wiring pattern for electrically coupling the first set of contacts and the second set of contacts and optional filtering components mounted on the internal printed circuit board.

For through-hole mounting use, the front portion of the inner housing part includes channels at a front edge, channels in a lower surface and slots extending from the lower surface to an upper surface alongside the vertical wall. The vertical wall of the inner housing part includes channels at an upper edge. The first set of contacts pass through the channels at the front edge of the inner housing part, through the channels in the lower surface of the inner housing part, through the slots in the front portion and through the channels at the upper edge of the vertical wall and connect to the internal printed circuit. Also, the rear portion of the inner housing part includes apertures extending from the cavity to a lower surface of the jack through which the second set of contacts pass.

For surface-mounting use, the front portion of the inner housing part includes channels at a front edge and channels in a lower surface and channels in a lower surface of the rear portion in alignment with the channels in the lower surface of the front portion. In this case, contact members are arranged partially in the channels in the lower surfaces of the front and rear portions and include a contact portion extending into the receptacle and terminal portions for attachment to the main printed circuit board.

Still another embodiment of a connector assembly for surface-mounting on a main printed circuit board comprises a jack receivable of an internal printed circuit board on which optional filtering components and light generating means are mounted. The jack includes an outer housing part and an inner housing part comprising a front, flat portion, a vertical wall extending perpendicular to the front portion and a rear portion extending rearward from the vertical wall. The rear portion comprises a pair of opposed projections. The internal printed circuit board is arranged at least partially between the projections of the inner housing part. A first set of contacts includes contact portions arranged in the receptacle and are connected at an opposite end to the internal printed circuit board and a second set of contacts are connected at one end to the internal printed circuit board and including terminal portions at an opposite end which are adapted to engage the main printed circuit board. The internal printed circuit board includes a wiring pattern for electrically coupling the first set of contacts, the second set of contacts and optional filtering components and light generating means. The light generating means may comprise at least one LED arranged in alignment with a respective light transmitting section of the light pipe element.

An advantage of this embodiment is that an insert assembly is connected to the internal printed circuit board and includes the second set of contacts. The terminal portion of the contacts in the second set of contacts are adapted to be surface-mounted to the main printed circuit board and thus, by manufacturing the insert assembly separately, it can be assured that the terminal portions are co-planar thereby avoiding problems when mounting the connector assembly to the main printed circuit board.

DESCRIPTION OF THE DRAWINGS

A more complete appreciation of the present invention and many of the attendant advantages thereof will be readily understood by reference to the following detailed description when considered in connection with the accompanying drawings in which:

FIG. 26 is a top view of the LED holder assembly and shield for use in the through-hole-mountable connector assembly shown in FIGS. 4–6 prior to connection;

FIG. 27 is a side view of the LED holder assembly and shield for use in the through-hole-mountable connector assembly shown in FIGS. 4–6 prior to connection;

FIG. 28 is a side view of the LED holder assembly and shield for use in the through-hole-mountable connector assembly shown in FIGS. 4–6 after connection;

FIG. 38 is a side view of another embodiment of a through-hole-mountable jack in accordance with the invention including a visual indicator with portions cut-away;

FIG. 39 is an exploded view of the jack shown in FIG. 38 with portions cut-away; and FIG. 40 is a side view of another embodiment of a surface-mountable jack in accordance with the invention including a visual indicator.

DETAILED DESCRIPTION OF THE PREFERRED EMBODIMENTS

Figure 1:
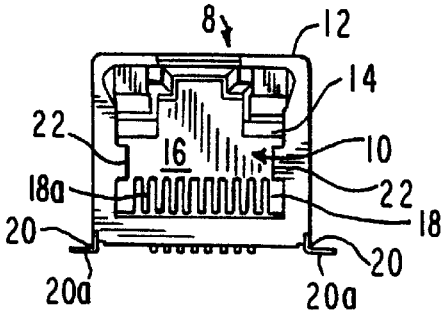
FIG. 1 is a front view of a surface-mountable connector assembly in accordance with the invention.

There are several different constructions of modular connector assemblies described below. Each construction will be described separately. Differences between the constructions include the manner in which the connector assembly is connected to a substrate such as a printed circuit board, i.e., whether the connector assembly is surface-mounted to the printed circuit board or through-hole mounted to the printed circuit board. Additional differences between the disclosed connector assemblies include the provision of visual indicators in some of the connector assemblies but not others as well as on-board or integrated magnetic filtering components in some of the connector assemblies but not others. Various combination of these features may be applied in practice and some combinations are disclosed below. The same reference numerals will be used to designate identical or similar elements throughout the several views.

Figure 2:
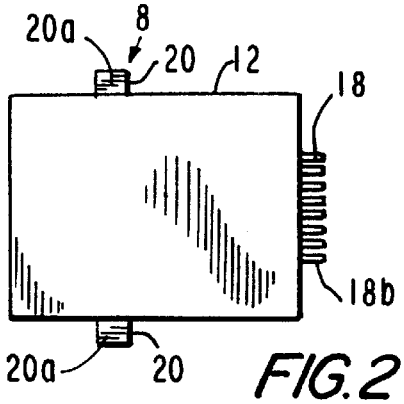
FIG. 2 is a top view of the connector assembly of FIG. 1.
Figure 3:
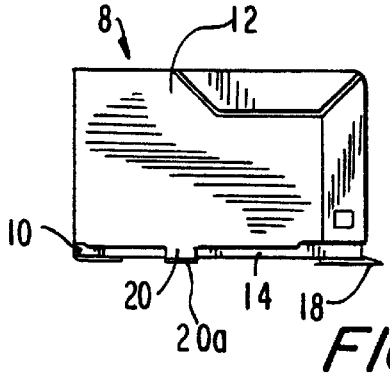
FIG. 3 is a side view of the connector assembly of FIG. 1.

Referring first to FIGS. 1–3, a surface-mountable connector assembly 8 in accordance with the invention including a surface-mountable jack 10 and a shield 12 is shown. Jack 10 includes a housing 14 defining a plug-receiving receptacle 16 and contact members 18 arranged in the housing 14 (shown more clearly in FIGS. 15–17). Each contact member 18 has a contact portion 18*a* situated in the receptacle 16 and a terminal portion 18*b* extending rearward from the rear face of the jack 10 and slightly below the lower face of the jack 10. The terminal portions 18*b* are adapted to be coupled to mating pads on the surface of the printed circuit board. To facilitate surface mounting of the connector assembly 8 to a printed circuit board and establish electrical grounding connection between the shield 12 and the ground of the printed circuit board, each lower side edge of the shield 12 includes an outwardly projecting L-shaped tab 20 having a flat portion 20*a* adapted to be coupled to a grounding region of the printed circuit board.

The flat portions 20*a* may be arranged in-line, i.e., at the same distance rearward of the front face of the connector assembly 8 as shown, or offset from one another, i.e., at different distances rearward of the front face of the connector assembly 8. Shield 12 includes tabs 22 extending from the front face of the shield 12 inward into the receptacle 16 and may also include other grounding tabs as disclosed herein. In the illustrated embodiment, the jack 10 is of the RJ-45 type in that it includes eight contact members 18. Also, the housing 14 may optionally include mounting posts for facilitating connection of the jack to a printed circuit board. Additional details of the construction of the jack housing 14 are set forth below with reference to FIGS. 15–17.

Figure 4:
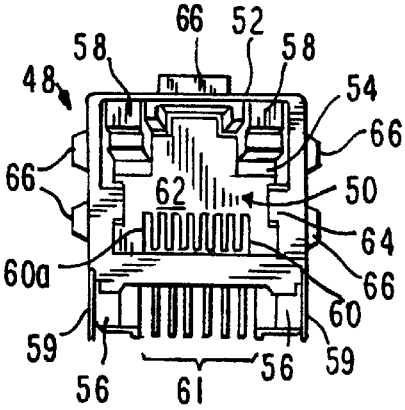
FIG. 4 is a front view of a through-hole-mountable connector assembly in accordance with the invention.
Figure 5:
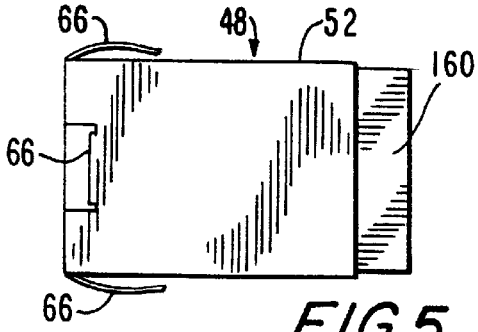
FIG. 5 is a top view of the connector assembly of FIG. 4.
Figure 6:
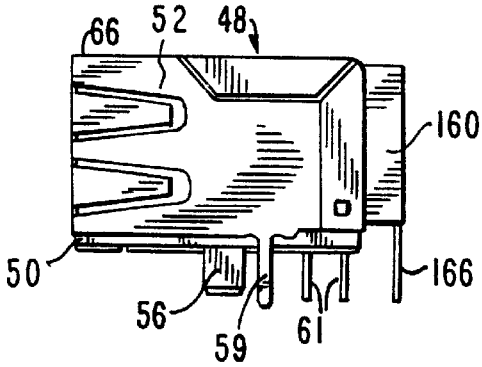
FIG. 6 is a side view of the connector assembly of FIG. 4.

FIGS. 4–6 is a through-hole-mountable connector assembly 48 in accordance with the invention including a through-hole-mountable jack 50, a shield 52 arranged around the jack 48 and an external LED holder 160 on which a pair of LEDs are arranged. Jack 50 includes a housing 54 which is substantially identical to the housing 14 of the surface-mountable jack 10. Light transmitting elements 58 are arranged in channels formed in the stepped portion of the housing 54 and in alignment with the LEDs on the external LED holder. Additional details of the construction of the light transmitting elements 58 are discussed below. Contact members 60 are also arranged in the housing 54, each having a contact portion 60*a* situated in a plug-receiving receptacle 62. As described more fully below, a magnetic filtering component 180 (see FIGS. 24 and 25) is also arranged in the housing 54 and provides terminal pins 61 extending downward from the lower face of the connector assembly 48 for insertion into corresponding apertures in the printed circuit board. The LED holder 160 secures leads 166 of the LEDs which extend downward from the lower face of the connector assembly 48 for insertion into corresponding apertures in the printed circuit board. Also, to establish electrical grounding connection between the shield 52 and the ground of the printed circuit board, each lower side edge of the shield 52 includes a downward facing tab 59 adapted to be pass through an aperture in the printed circuit board and be coupled to a grounding region thereof. The shield 52 also includes tabs 64 extending from a front face of the shield 52 inward into the receptacle 62 and additional mounting and/or grounding implements 66, such as grounding tabs, on the upper and side faces. The housing 54 generally includes mounting posts 56 on a lower surface thereof which are adapted to be inserted into corresponding apertures in the printed circuit board to enable securing of the jack 50 to the printed circuit board. By contrast, such mounting posts are optional feature on the housing 14 of jack 10. In the illustrated embodiment, the jack 50 is of the RJ-45 type in that it includes eight contact members 60.

Referring now to FIGS. 7–14, the components of the housing 54 are shown separately. Housing 54 includes an outer housing part 68 shown in FIGS. 7–10 and an inner housing part 70 shown in FIGS. 11–14. Both the outer and inner housing parts 68,70 are made of dielectric material. As noted above, housings 14,54 have the same general construction, with the exception that the housing 54 of the jack 50 includes mounting posts 56 whereas such mounting posts are optional on housing 14 of the jack 10 and not shown in the illustrated embodiment. As such, the outer housing part of jack 10 is the same as the outer housing part 68 of jack 50 with the possible exception of mounting posts and the inner housing part of jack 10 is identical to the inner housing part 70 of jack 50. Thus, the same outer and inner housing parts could be used for a surface-mountable connector assembly or a through-hole-mountable connector assembly.

Figure 7:
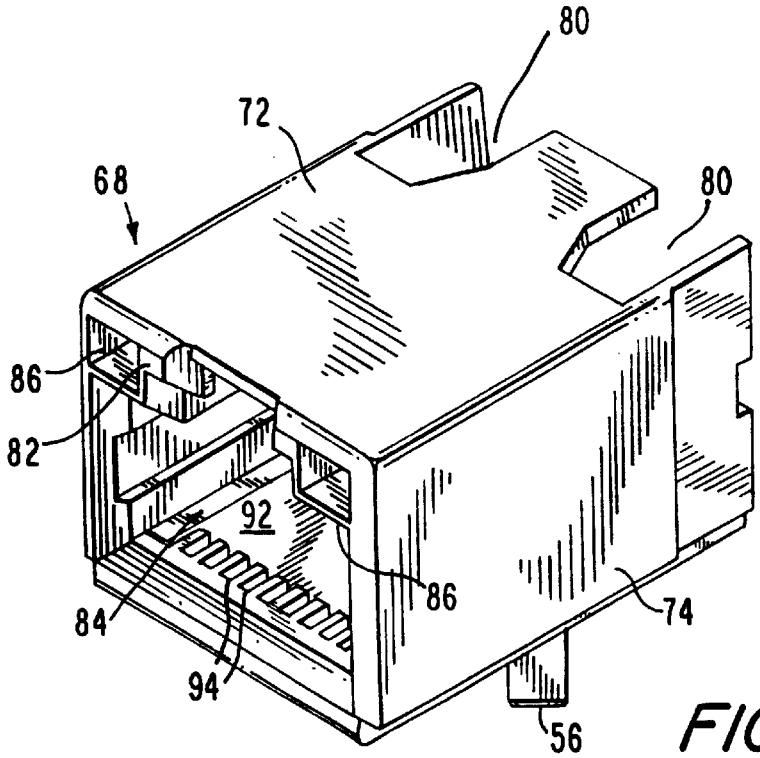
FIG. 7 is a front perspective view of an outer housing part of a jack in accordance with the invention.
Figure 8:
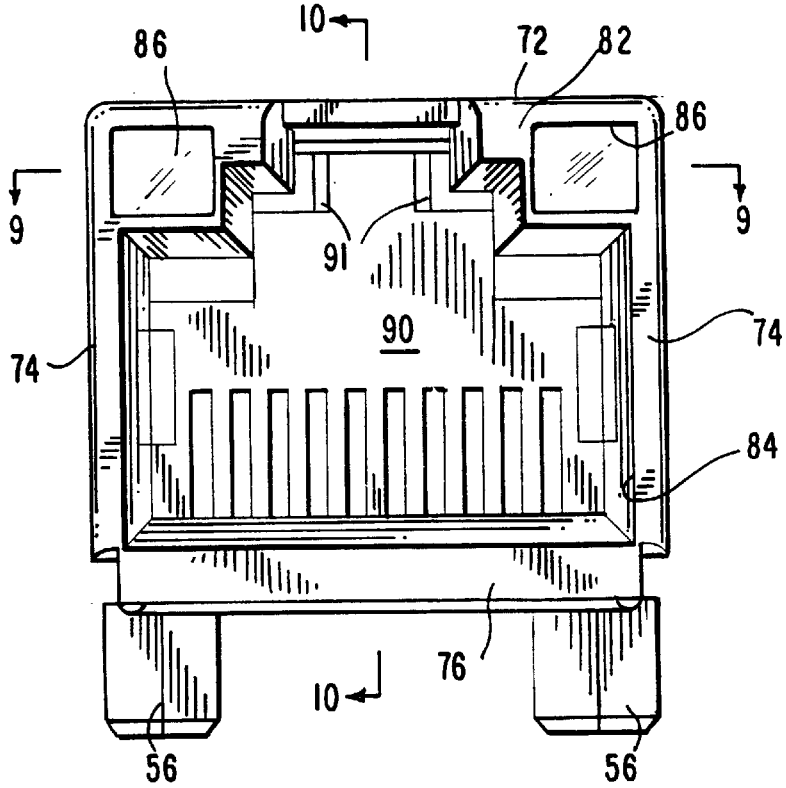
FIG. 8 is a front view of the outer housing part of FIG. 7.
Figure 9:
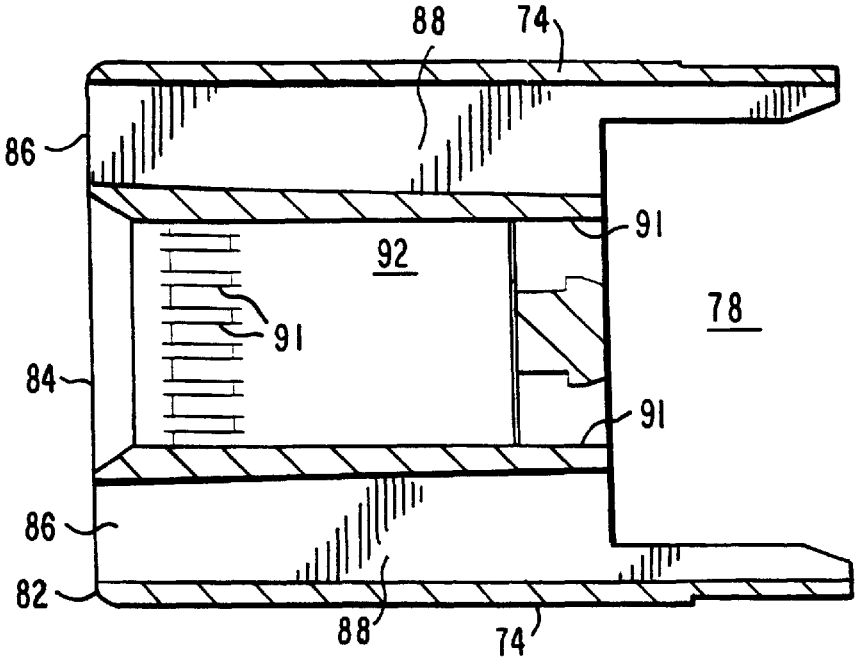
FIG. 9 is a cross-sectional view of the outer housing part of FIG.7 taken along the line 9—9 of FIG. 8.
Figure 10:
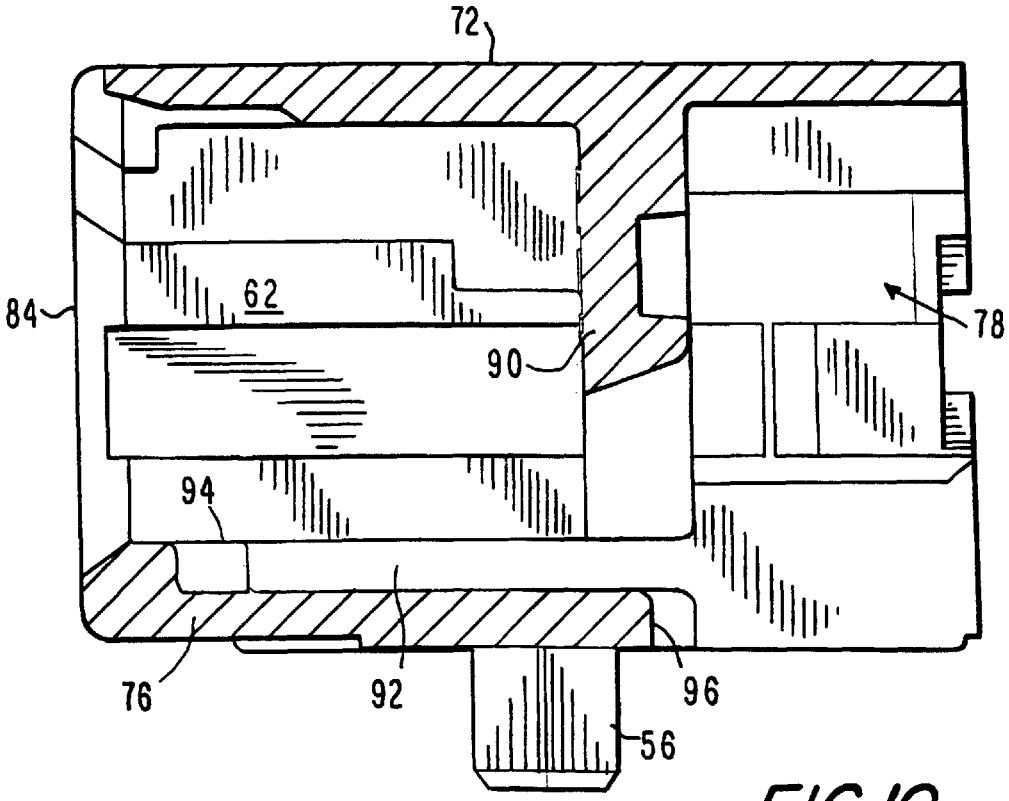
FIG. 10 is a cross-sectional view of the outer housing part of FIG. 7 taken along the line 10—10 of FIG. 8.
Figure 11:
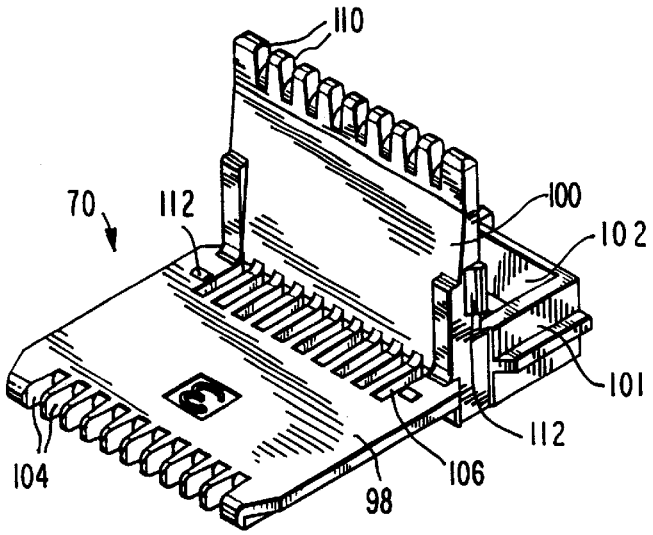
FIG. 11 is a front perspective view of an inner housing part of a jack in accordance with the invention.
Figure 12:
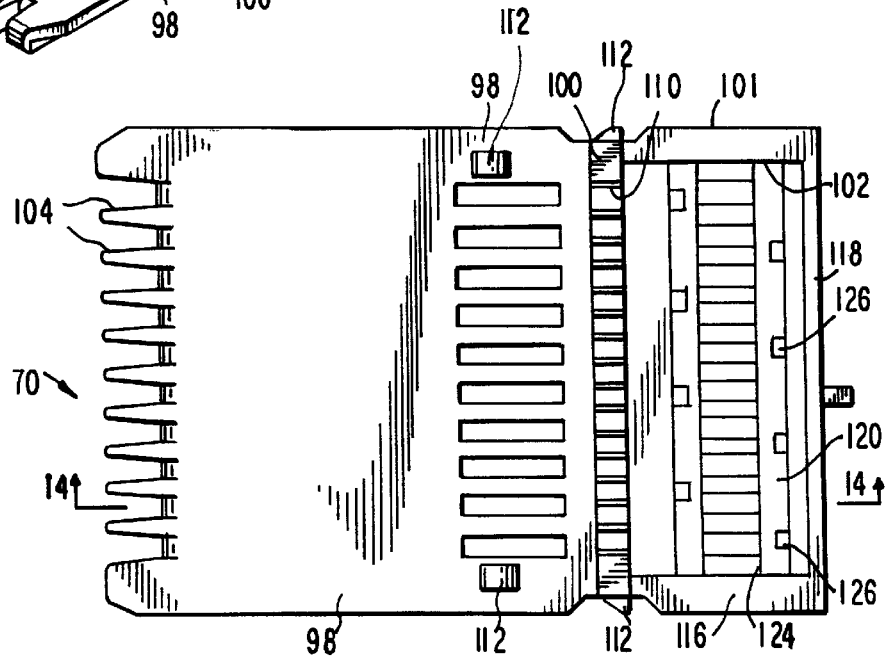
FIG. 12 is a top view of the inner housing part shown in FIG. 11.

As shown in FIG. 7, the outer housing part 68 includes a top wall 72, side walls 74 and a bottom wall 76. A portion of the top wall 72 and side walls 74 extend beyond a rear edge of the bottom wall 76 to thereby define a cavity 78 at the rear of the outer housing part 68 into which the inner housing part 70 is inserted (FIG. 9). The top wall 72 is shaped to define recesses 80 at a rear thereof (FIG. 7). The front face 82 of the outer housing part 68 includes a plug aperture 84 and apertures 86 in each stepped portion. Outer housing part 68 includes a pair of elongate channels 88 extending from the apertures 86 in the front face 82 rearward to the cavity 78 (FIG. 9). Outer housing part 68 also includes a comb portion 90 defining a plurality of slots for receiving ends of the contact members 60. A pair of apertures 91 are situated in the comb portion 90 above the slots, the purpose of the apertures 91 is explained below with reference to FIG. 19. A slot 92 is formed along the bottom wall 76 and eight tongues 94 extend from a forward end of slot 92 therein (FIG. 10). Channels 96 are formed in the rear edge of the bottom wall 76 (FIG. 10). The purposes of slot 92, tongues 94 and channels 96 is explained below. The interior walls at a front portion of the outer housing part 68 forward of the comb portion 90 define the receptacle 62. Mounting posts 56 extend downward from the bottom wall 76. Top wall 72 includes complementary surfaces adapted to receive and retain the latch of a mating plug.

Figure 13:
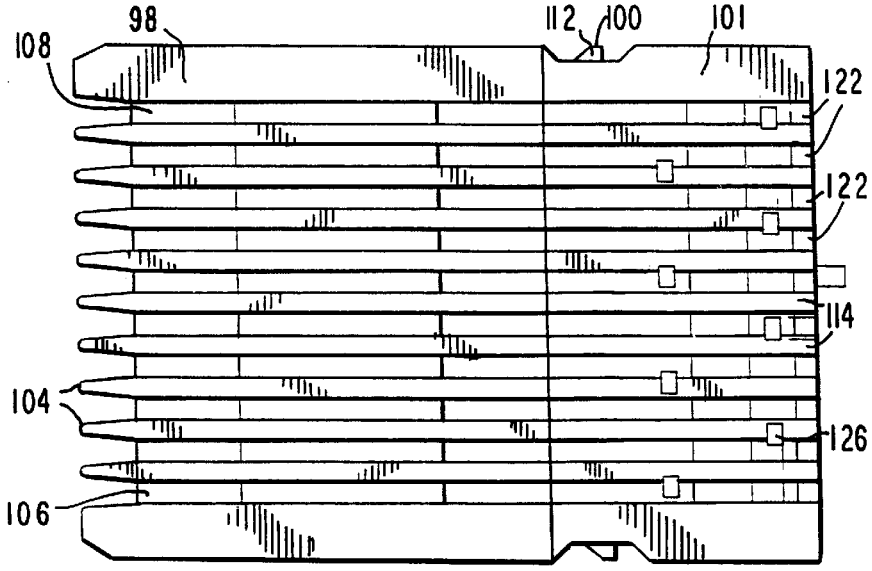
FIG. 13 is a bottom view of the inner housing part shown in FIG. 11.
Figure 14:
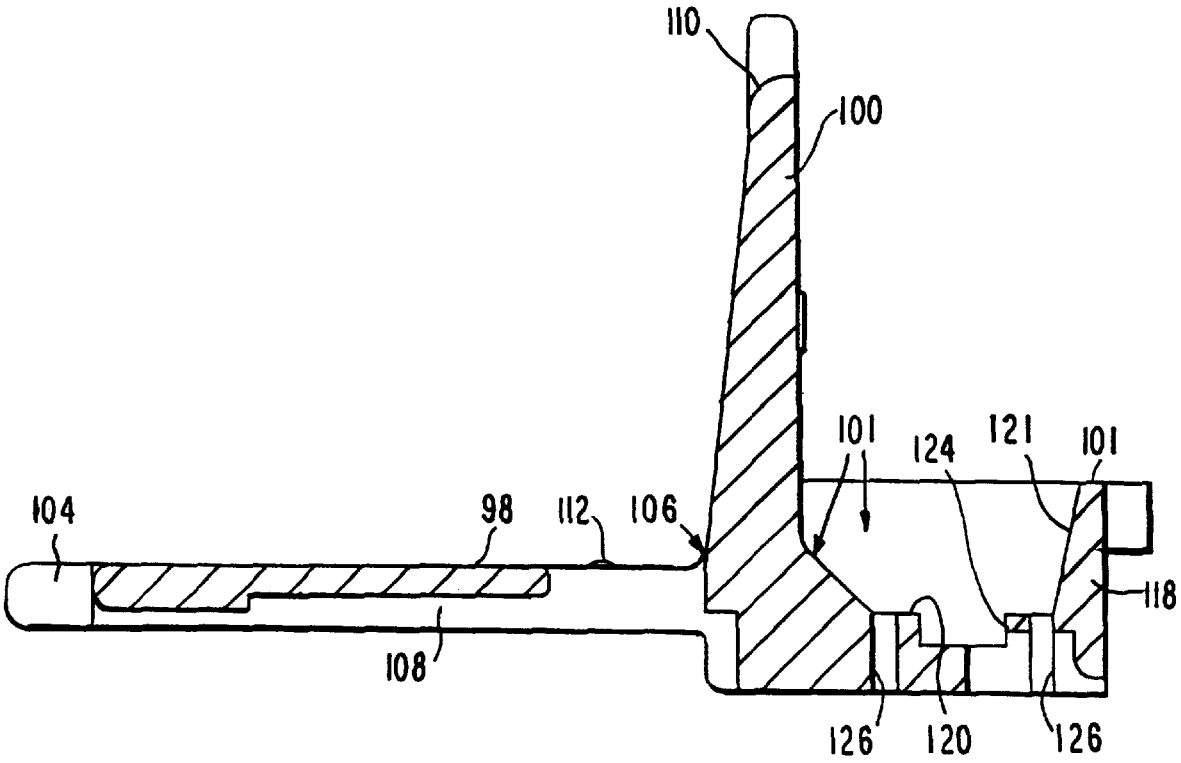
FIG. 14 is a cross-sectional view of the inner housing part of FIG. 11 taken along the line 14—14 of FIG. 12.

Referring now to FIGS. 11–14, the inner housing part 70 is shown. Inner housing part 70 includes a front flat portion 98, a vertical wall 100 extending upward from flat portion 98 and a rear portion 101 defining a cavity or well 102. Eight guide channels 104 are formed in the front edge of flat portion 98 and eight slots 106 are formed at the rear of flat portion 98 adjacent the vertical wall 100. Also, eight guide channels 108 are formed on a lower surface of flat portion 98, each extending from one of the channels 104 to a respective one of the slots 106 (FIG. 13). Channels 104, slots 106 and channels 108 are dimensioned to accommodate a contact member 60. Eight guide channels 110 are also formed at the upper edge of vertical wall 100 and dimensioned to accommodate a contact member 60. Ridges 112 are formed on the upper surface of flat portion 98 and the side surfaces of vertical wall 100 to facilitate securing of the inner housing part 70 to the outer housing part 68. The cavity 102 is defined by a rear surface of the vertical wall 100, side walls 116, a rear wall 118 and a lower wall 120. Eight guide channels 114 are formed on the lower surface of lower wall 120, each in alignment with a respective one of the guide channels 108. The rear end 122 of the channels 114 adjacent the rear wall 118 has a depth less than the remaining portion of the channels 114, the reason for which is explained below. The cavity 102 is provided with a depth necessary to accommodate a filtering circuit mounted on a circuit board (discussed below) and to this end, includes a rectangular slot 124 formed at a bottom thereof in order to maximize the available vertical dimension. Further, eight apertures 126 are formed in the lower wall 120 to allow for passage of terminal pins of the filtering component 180 to enable connection of the terminal pins 182 to a printed circuit board.

The outer and inner housing parts 68,70 described above are used in several of the connector assembly embodiments described herein, both surface-mountable connector assemblies and through-hole-mountable connector assemblies.

Figure 15:
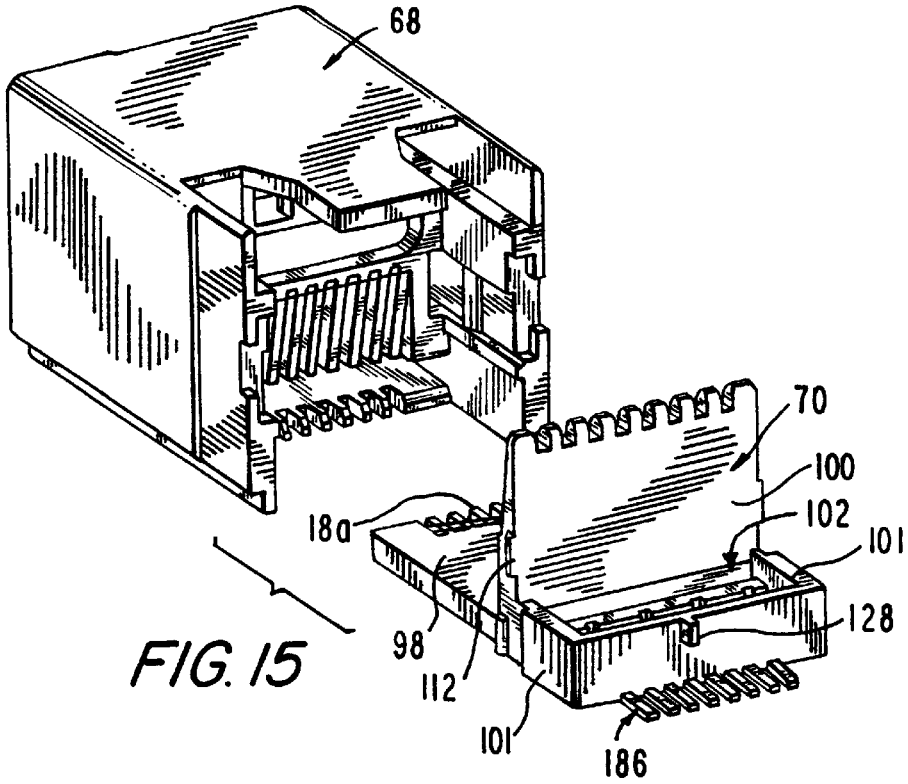
FIG. 15 is an exploded rear perspective view of a surface-mountable jack in accordance with the invention for use in the connector assembly shown in FIGS. 1–3.
Figure 16:
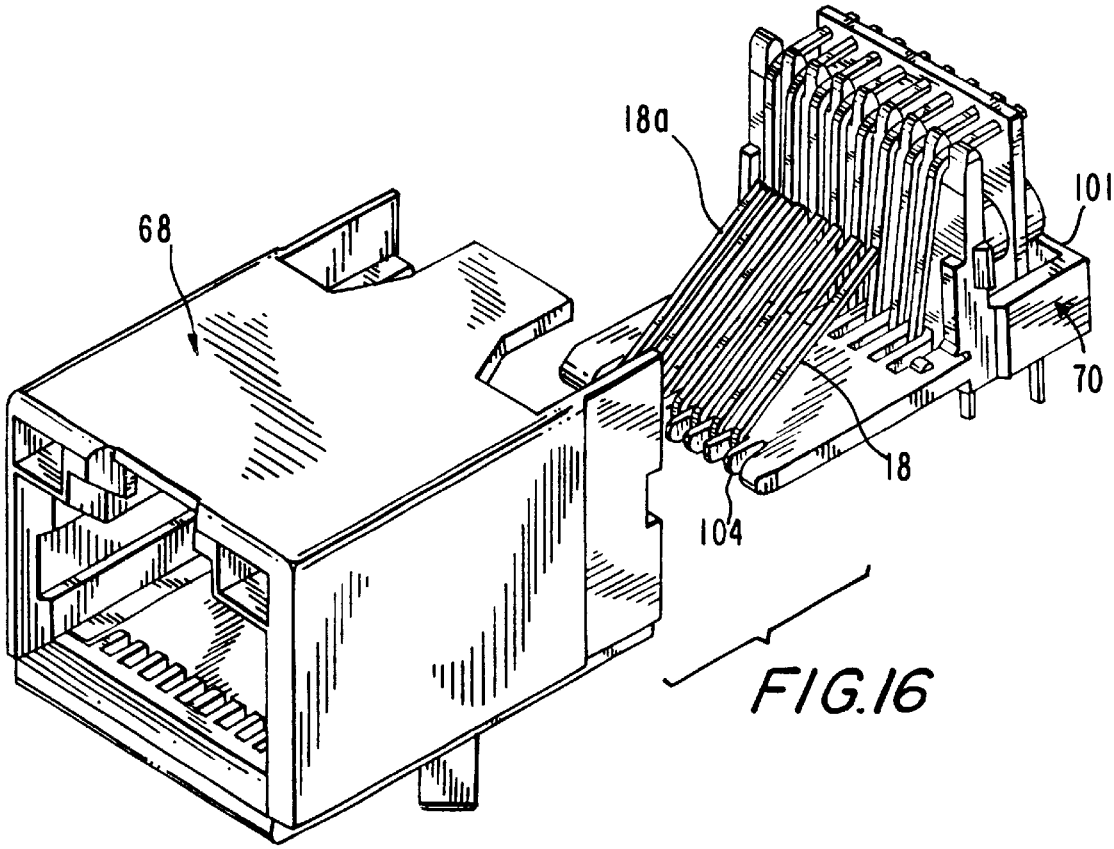
FIG. 16 is an exploded front perspective view of the jack shown in FIG. 15.
Figure 17:
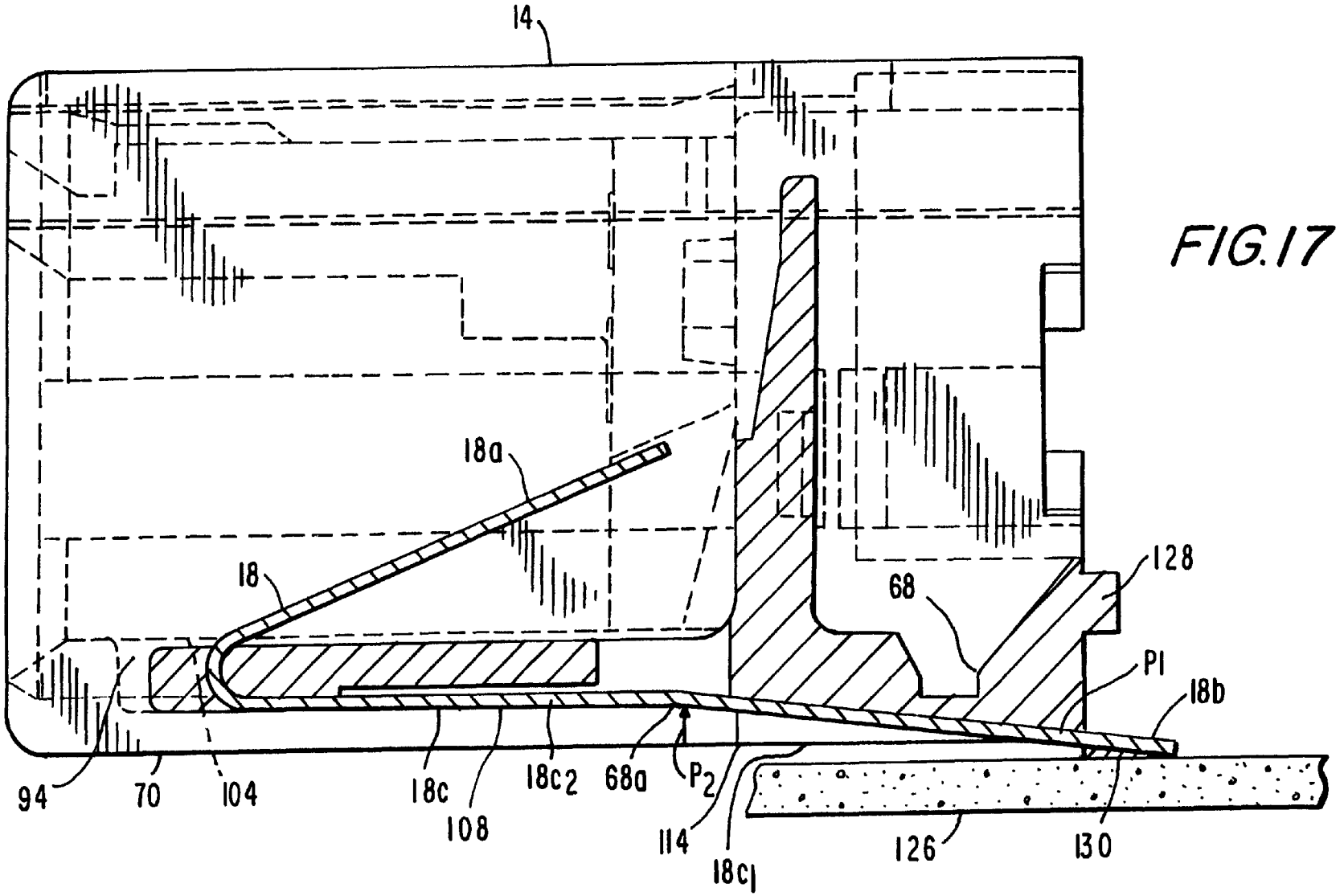
FIG. 17 is a cross-sectional view of the jack shown in FIG. 16 in a mounting position to a printed circuit board.

A first embodiment of a surface-mountable connector assembly 8 utilizing outer and inner housing parts 68,70 is shown in FIGS. 1–3 and its assembly will now be described with reference to FIGS. 15–18. (Outer housing part 68 does not include mounting posts 56.) First, to assemble the jack 10, appropriate contact members 18 are stamped and arranged in connection with the inner housing part 70 such that the contact portions 18*a* extend in an obliquely inclined plane from the front of the flat portion 98 and intermediate bridging portions 18*c* of the contact members 18 extend through the channels 104 into channels 108 formed on the lower surface of the flat portion 98 and through channels 114 formed in the lower wall 120 of the rear portion 101 of the inner housing part 70 (FIGS. 15 and 16). The terminal portions 18*b* of the contact members 18 descend obliquely downwardly for attachment to a printed circuit board in view of the lesser depth of the rear end 122 of the channels 114. As such, an upper surface of a first planar portion 18*c*1 of an intermediate bridging portion 18*c* of each contact member 18 abuts against the rear end 122 of a respective channel 114 (FIG. 17). This location is designated P1 (FIG. 17).

Thereafter, the inner housing part 70 is inserted into the outer housing part 68 to form jack 10 by sliding the flat portion 98 of the inner housing part 70 into the slot 92 in the outer housing part 68 until the ridges 112 snap into mating structures of the outer housing part 68. Insertion of the inner housing part 70 into the outer housing part 68 is guided by the presence of the tongues 94 of the outer housing part 68 which enter into the channels 104 (see FIG. 17).

Upon insertion of the inner housing part 70 having the contact members 18 arranged in connection therewith into the outer housing part 68, at least a portion of the lower surface of a second planar portion 18*c*2 of the intermediate portion 18*c* of the contact members 18 will abut against a surface 68*a* of the outer housing part 68 (this location being designated P2 in FIG. 17). As a result of the abutment of the upper surface of the contact members 18 against the rear end 122 of channels 114 and the abutment of the lower surface of the contact members 18 against the surface 68*a* of the outer housing part 68, the contact members 18 will be secured or "entrapped" in the jack 10 so that the angle of the terminal portion 18*b* of all of the contact members 18 relative to the bottom surface of the jack 10, and thus to the mounting substrate (printed circuit board 126) on which the jack 10 will be mounted, will be substantially the same, i.e., the terminal portions 18*b* will be co-planar.

The co-planar arrangement of the terminal portions 18*b* of the contact members 18 provides significant advantages. For example, since jacks are constructed with a number of contact members, each contact member may have mechanical properties that differ from those of the other contact members. This difference in mechanical properties causes irregularities when the contact members are formed in a conventional stamping operation and a jack is assembled with the same. Entrapping the contact members upon assembly of the jack 10 eliminates the problem caused by different mechanical properties of the contact members.

Moreover, since the angle of the terminal portions 18*b* is the same, a solder web 130 may be formed along the terminal portion 18*b* of each contact member 18 and will be properly aligned for a soldering operation in which the contact members 18 are electrically coupled to the printed circuit board 126 (see FIG. 17).

Another advantage of the entrapment design is that the connector assembly time is shortened because secondary forming operations in which the contact members are manipulated and positioned are eliminated.

Yet another advantage is that the contact members 18 may be pre-loaded into the inner housing part 70 and thereby prevent shorting of the contact members to one another. As such, assembly of the jack would entail only insertion of the inner housing part 70 into the outer housing part 68.

Shield 12 may then be placed over the jack 10 and the shielded jack then coupled to the printed circuit board 126 (FIG. 17). Shield 12 may be secured to jack 10 by means of a staking post 128 arranged on the rear wall 118 of the inner housing part 70 (FIGS. 15 and 17). Although the jack 10 shown in FIGS. 15–17 includes eight contact members, the outer housing part 68 and inner housing part 70 may be constructed to receive any number of contact members. Also, the outer housing part 68 and inner housing part 70 may be constructed differently, e.g., in shape, yet still provide the advantages of this embodiment of the invention if channel or bores are formed in one housing part to receive the contact members and, when this housing part is assembled together with the other housing part, the two housing parts cooperate to entrap the contact members in a particular position. Also, although the channels 114 are shown formed in the inner housing part 70, it is within the scope and spirit of the invention to provide channels in the outer housing part 68 instead.

Furthermore, although not shown, a LED holder and light pipe element described below may be arranged in the jack 10 since the outer housing part 68 is formed to receive such a light pipe element and the shield 12 may be formed to mate with the LED holder. However, it is envisioned that the jack may be constructed without the LED holder and light pipe element, in which case, inter alia, the top surface of the outer housing part 68 does not necessarily require cavities 80, the front face of the outer housing part 68 would not necessarily include apertures 86 and channels 88 would not be formed in the outer housing part 68.

Figure 18:
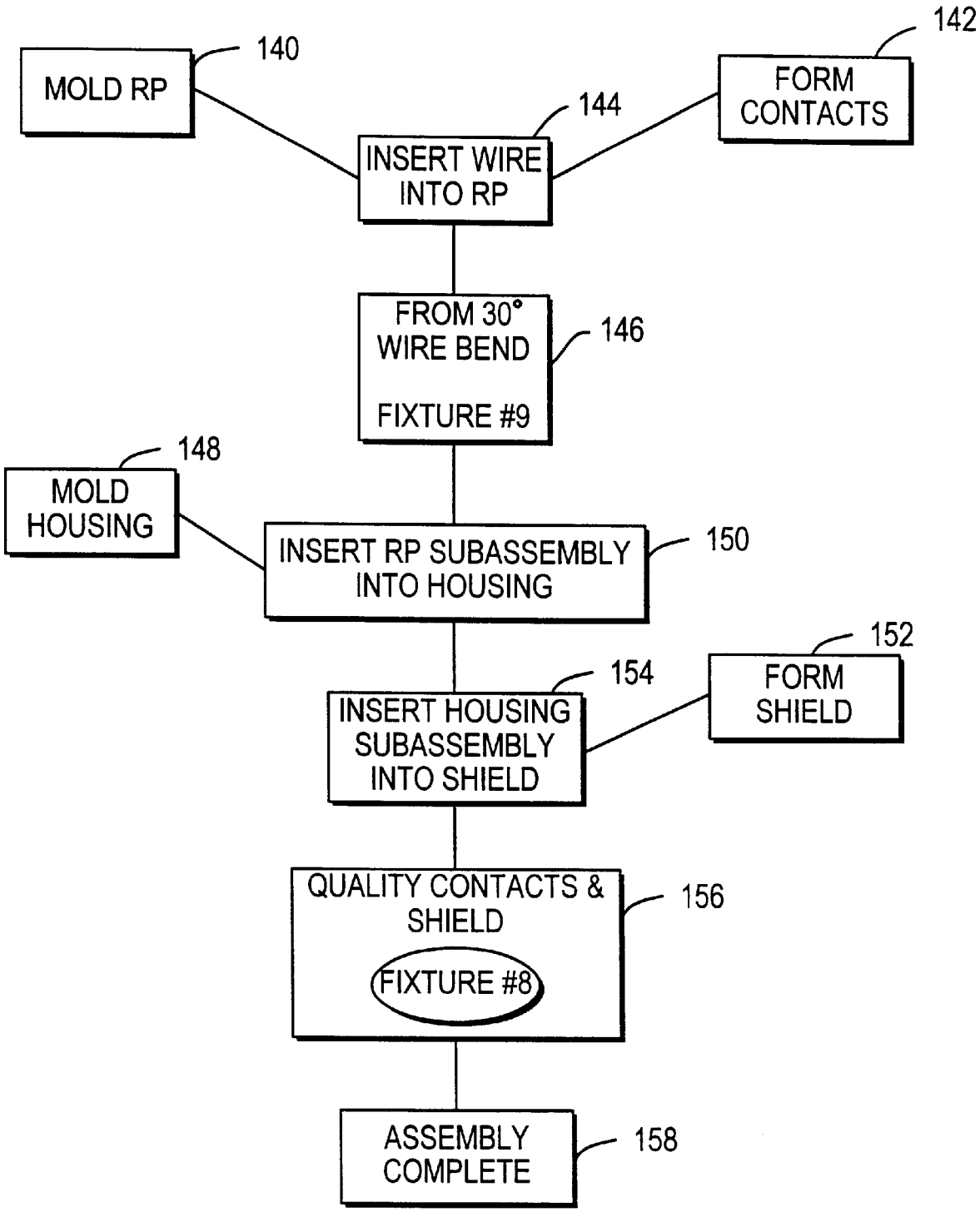
FIG. 18 is a flow chart of one non-limiting process for manufacturing the connector assembly shown in FIGS. 1–3.

FIG. 18 is a flow chart for the manufacture of the connector assembly shown in FIGS. 1–3 including the jack 10 shown in FIGS. 15–17 (RP designating the inner housing part 70, which is also referred to as a rear plastic member). In the assembly process, a rear plastic subassembly is formed from the inner housing part 70 which is first molded (step 140) and contact members 18 which are formed or stamped (step 142). The contact members 18 are inserted into the inner housing part (step 144) and bent to form the oblique contact portions 18*a* (step 146). The outer housing part 68 is molded (step 148) and then the subassembly of the inner housing part 70 and contact members 18 is inserted into the outer housing part 68 (step 150) to form a jack 10. The shield 12 is formed (step 152) and the jack 10 is inserted into the shield 12 (step 154). The contact members 18 and shield 12 are tested (step 156) and then connector assembly 8 is complete (step 158). As noted above, the shield is an optional feature of the connector assembly.

A first embodiment of a through-hole-mountable connector assembly 48 utilizing outer and inner housing parts 68,70 is shown in FIGS. 4–6 and its assembly will now be described with reference to FIGS. 19–25. The connector assembly 48 also includes an optional visual indicator and a filtering circuit.

Figure 19:
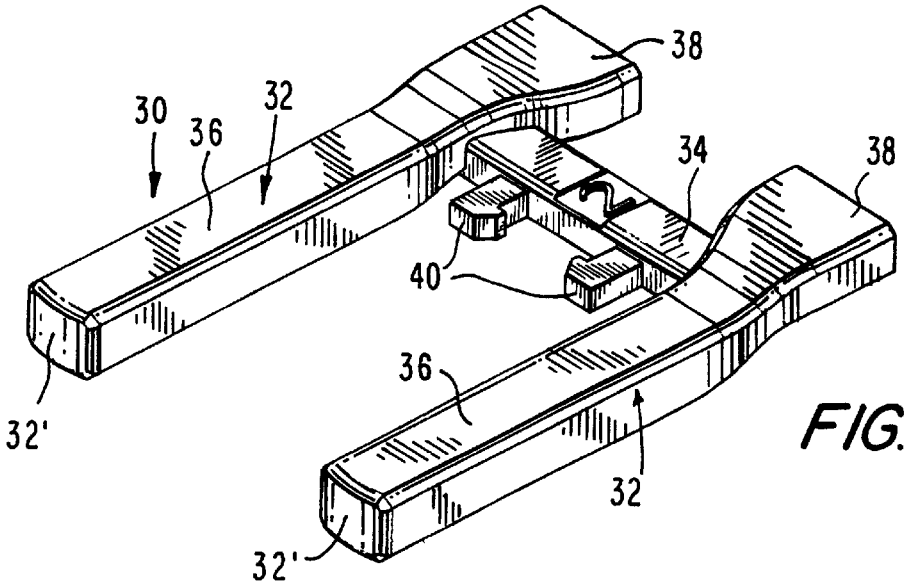
FIG. 19 is a view of a light pipe element for use in connector assemblies in accordance with the invention.

FIG. 19 is a light pipe element 30 for use with jacks in accordance with the invention, jack 50 as well as jack 10. The light pipe element 30 is a unitary piece of light transmitting material, such as plastic or glass, having a pair of elongate light transmitting sections 32 and a supporting structure 34 for connecting and supporting the same. Each light transmitting section 32 has an elongate front portion 36 dimensioned to fit within a respective channel 88 in the outer housing part 68 so that the front edge 32' of each light transmitting element 32 is adjacent the front face 42 of the outer housing part 68 (see FIG. 30). A rear portion 38 of the light transmitting sections 32 extends slight upward into the cavities 80 at the rear of the outer housing part 68 and have a larger cross-section that the front portion 36. The supporting structure 34 includes latches 40 for cooperating with the apertures 91 above the comb portion 90 of the outer housing part 68 to secure the light pipe element 30 to the outer housing part 68. The overall length of the light pipe element 30 is slightly less than the length of the top and side walls 72,74 of the outer housing part 68 such that the rear edge of the light transmitting sections 32 will be slightly inward of the rear edge of the outer housing part 68 (see FIG. 30). Although shown as a unitary piece of light transmitting material, it is possible to construct the light pipe element from multiple components and/or from different materials so long as the light transmitting sections are made of a light transmitting material.

FIGS. 20–23 show an LED holder 160 for use in the jacks in accordance with the invention. The LED holder 160 includes a frame member 161 which supports two LED assemblies 162. Each LED assembly 162 includes an LED body or bulb 164 and a pair of contacts or contact members 166. As discussed below, the LED assemblies 162 are arranged relative to the outer housing part 68 such that each LED assembly 162 will align with a respective light transmitting section 32 of the light pipe element 30. Contacts 166 extend from the bulb 164 rearward and then downward along a rear surface of the LED holder 160 through channels 168 to project beyond the lower surface of the LED holder 160 and thereby enable electrical attachment to a printed circuit board on which the jack is mounted. Contacts 166 are snapped into channels 168 so that the LED assemblies 162 are secured to the LED holder 160. The LED holder 160 also includes mounting posts 170 extending from a front surface to enable attachment of the LED holder 160 to a shield 12,52 of the connector assembly 10,50, respectively. A small overhang 172 is also provided at the upper edge of the LED holder 160 to prevent vertical movement of the LED assemblies 162.

It must be appreciated that the LED bulbs 164 are not situated in the jack housing formed by the inner and housing parts 68,70. Thus, it is an advantage of the invention that there is no limitation on the size of the LED bulbs, which limitation is present in prior art constructions in which the LED bulbs are situated in the jack housing and the size of the jack housing must therefore conform to specific industry standards.

Figure 25:
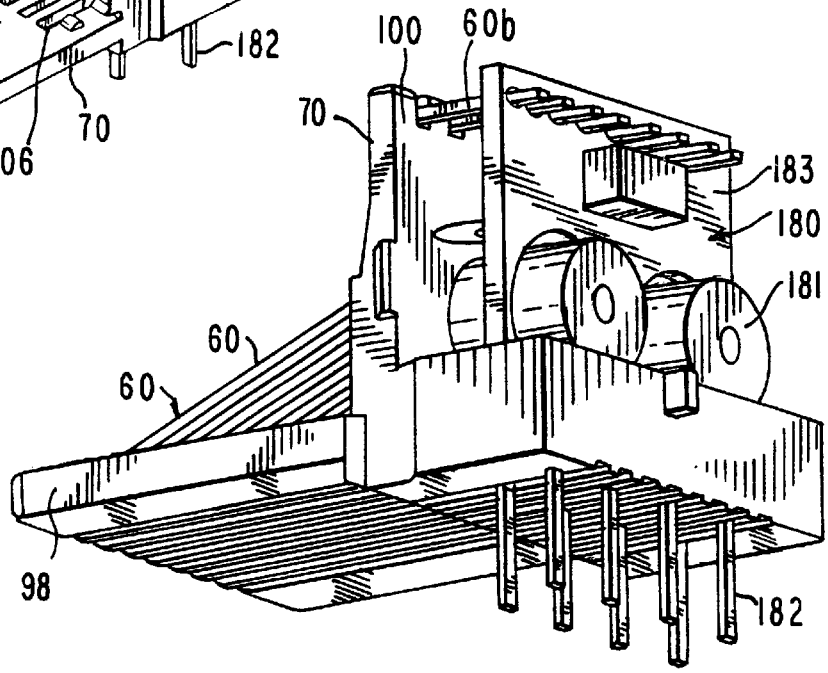
FIG. 25 is a rear perspective view of the assembly shown in FIG. 24.
Figure 20:
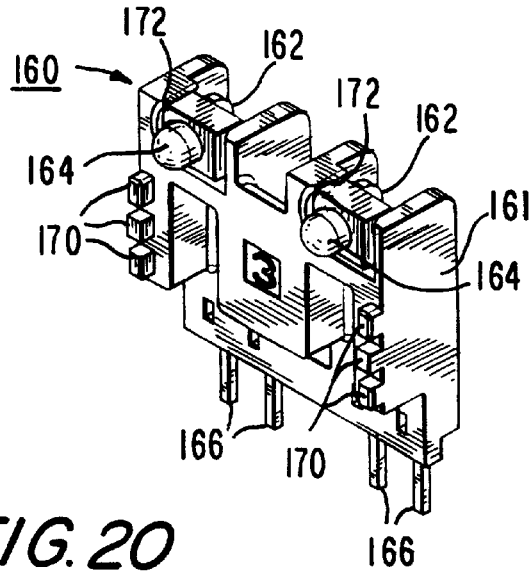
FIG. 20 is a view of an LED holder assembly for use in the connector assemblies shown in FIGS. 4–6.
Figure 21:
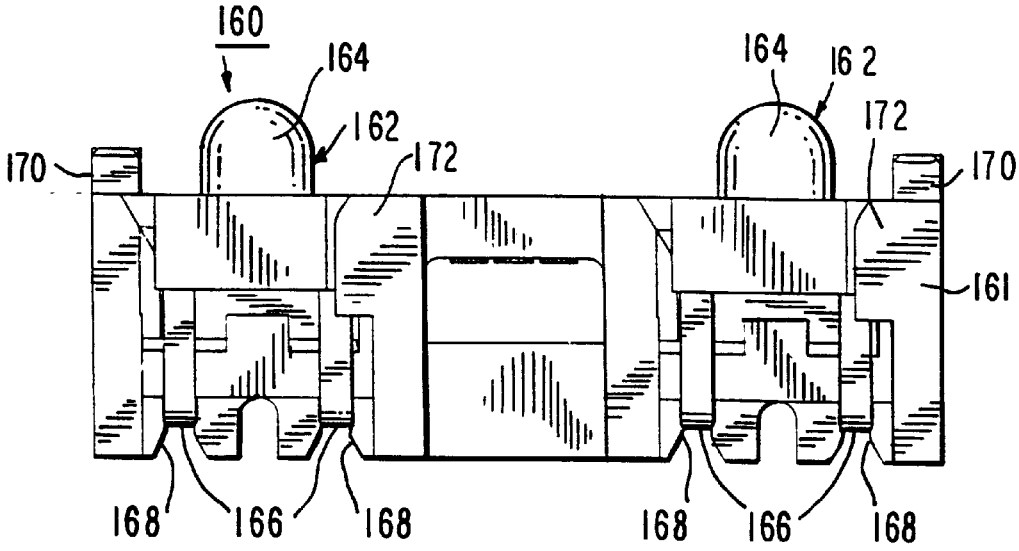
FIG. 21 is a top view of the led holder assembly shown in FIG. 20.
Figure 23:
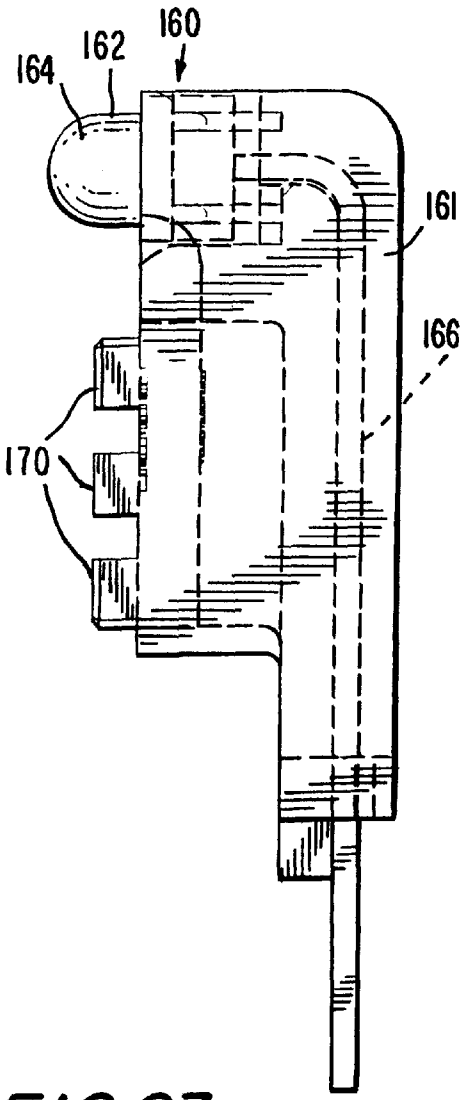
FIG. 23 is a side view of the LED holder assembly shown in FIG. 20.
Figure 22:
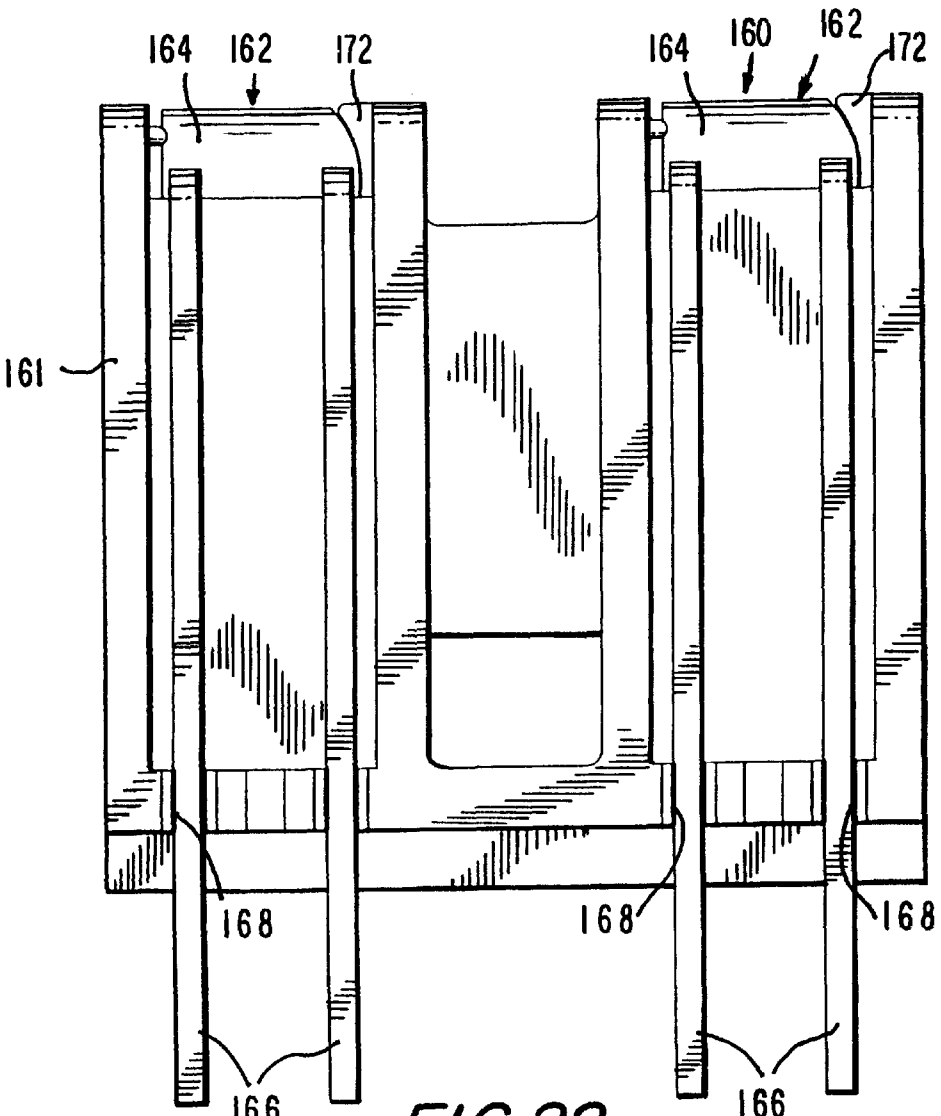
FIG. 22 is a rear view of the LED holder assembly shown in FIG. 20.

The filtering component 180 used in jack 50, as well as other connector assemblies in accordance with the invention, may be any type of filtering unit mounted on a printed circuit board and designed for insertion into a modular jack. As shown in FIG. 25, filtering component 180 includes a printed circuit board 183 having apertures at an upper region for receiving board portions **60*b* of the contact members 60, filtering components such as toroids 181 mounted on the printed circuit board 183, terminal pins 182 connected to the printed circuit board 183 and internal circuitry for forming an electrical circuit between the contact members 60 and the terminal pins 182 through the toroids 181 (e.g., a wiring pattern on the printed circuit board 183**). One such filtering unit is disclosed in Townsend et al. discussed above, although this filtering unit includes a capacitor which is not necessary nor shown in the illustrated embodiments.

A preferred construction of a shield 52 for the through-hole-mountable connector assembly 48 is shown in FIGS. 26 and 27 and includes a pair of apertures 184 on its rear face **52*a* and an additional pair of apertures 186 on the rear face 52. The purpose of these apertures 184,186 is explained below. Shield 52 is made of a metallic material and includes mounting and/or grounding implements 66** as is known in the art.

Referring now to FIGS. 24–30, the assembly of the through-hole-mountable connector assembly 48 will be described.

Figure 24:
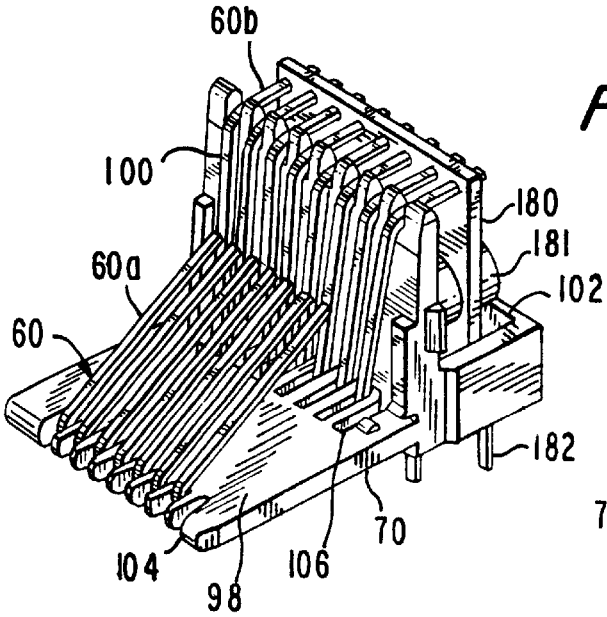
FIG. 24 is a front perspective view of an assembly of an inner housing part and a filtering unit for use in through-hole-mountable jacks in accordance with the invention.

First, the jack 50 is assembled. To this end, a set of eight appropriate contact members 60 are stamped and arranged in connection with the inner housing part 70 such that the contact portions **60*a* extend in an obliquely inclined plane from the front of the flat portion 98 and intermediate bridging portions 60*c* of the contact members 60 extend through the channels 108 and then pass through slots 106 and extend along a front face of vertical wall 100. A board portion 60*b* of the contact members 60 then passes through the channels 110 at the upper edge of the vertical wall 100. This is achieved by suitably bending the contact members 60. The filtering component 180 is inserted into the cavity 102 in the rear portion 101 of the inner housing part 70 such that the terminal pins 182 thereof extend through the apertures 126 and the board portions 60*b* are situated in the apertures at the upper region of the printed circuit board 183 (FIGS. 24 and 25). The filtering component 180 and board portions 60*b* of the contact members 60 are then electrically coupled to one another, e.g., by soldering, to arrive at the subassembly shown in FIGS. 24 and 25**.

In a separate stage, the light pipe element 30 is inserted into the outer housing part 68 such that the light transmitting sections 32 enter into channels 88 and whereby the latches 40 enter into apertures 91 to attach the light pipe element 30 to the outer housing part 68.

Figure 29:
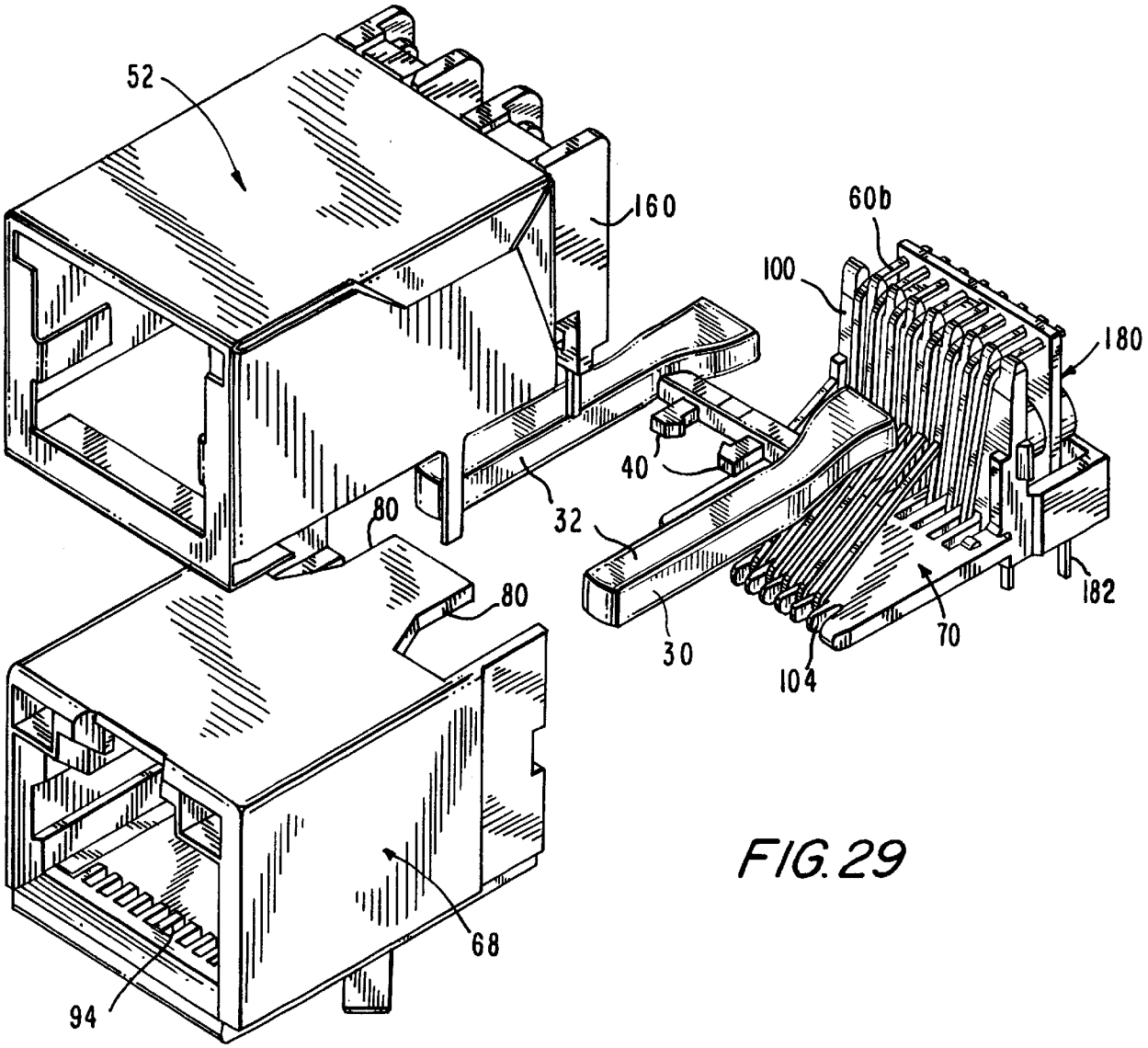
FIG. 29 is an exploded view of the connector assembly shown in FIGS. 4–6.

The subassembly of the inner housing part 70, contact members 60 and filtering component 180 is then inserted into the outer housing part 68 having the light pipe element 30 to form jack 10 by sliding the flat portion 98 of the inner housing part 70 into the slot 92 in the outer housing part 68 until the ridges 112 snap into mating structures of the outer housing part (see FIG. 29). Insertion of the inner housing part 70 into the outer housing part 68 is guided by the tongues 94 of the outer housing part 68 to enter into the channels 104. The filtering component 180 will be situated below the light pipe element 30.

Separately, the LED holder 160 is assembled and the joined to the shield 52 as depicted in FIGS. 26–28. To this end, the shield 52 includes elongate apertures 184 on a rear face 186 thereof adapted to receive the mounting posts 170 of the LED holder 160. After the mounting posts 170 of the LED holder 160 are situated in the respective aperture 184 of the shield 52, the middle mounting post on each side is cold-formed or otherwise staked (represented by arrow 185) to thereby secure the LED holder 160 to the shield 52. Other means for connecting the LED holder 160 to the shield 52 may also be used.

The subassembly of the shield 52 and LED holder 160 is then placed over the jack 10 and the rear face of the shield 52 is bent over the rear of the jack 10 to mate with the side faces **52*b* and enclose the jack 10 within the shield 52 and thereby form connector assembly 48. The connector assembly 48 is then mounted on the substrate such as a printed circuit board by insertion of the mounting posts 56 through corresponding apertures in the printed circuit board and the terminal pins 182 and contacts 166 are electrically connected to pads on the printed circuit board. Shield 52 may also be cold-staked to the jack 10 by means of the staking post 128 on the inner housing part 70**.

Figure 30:
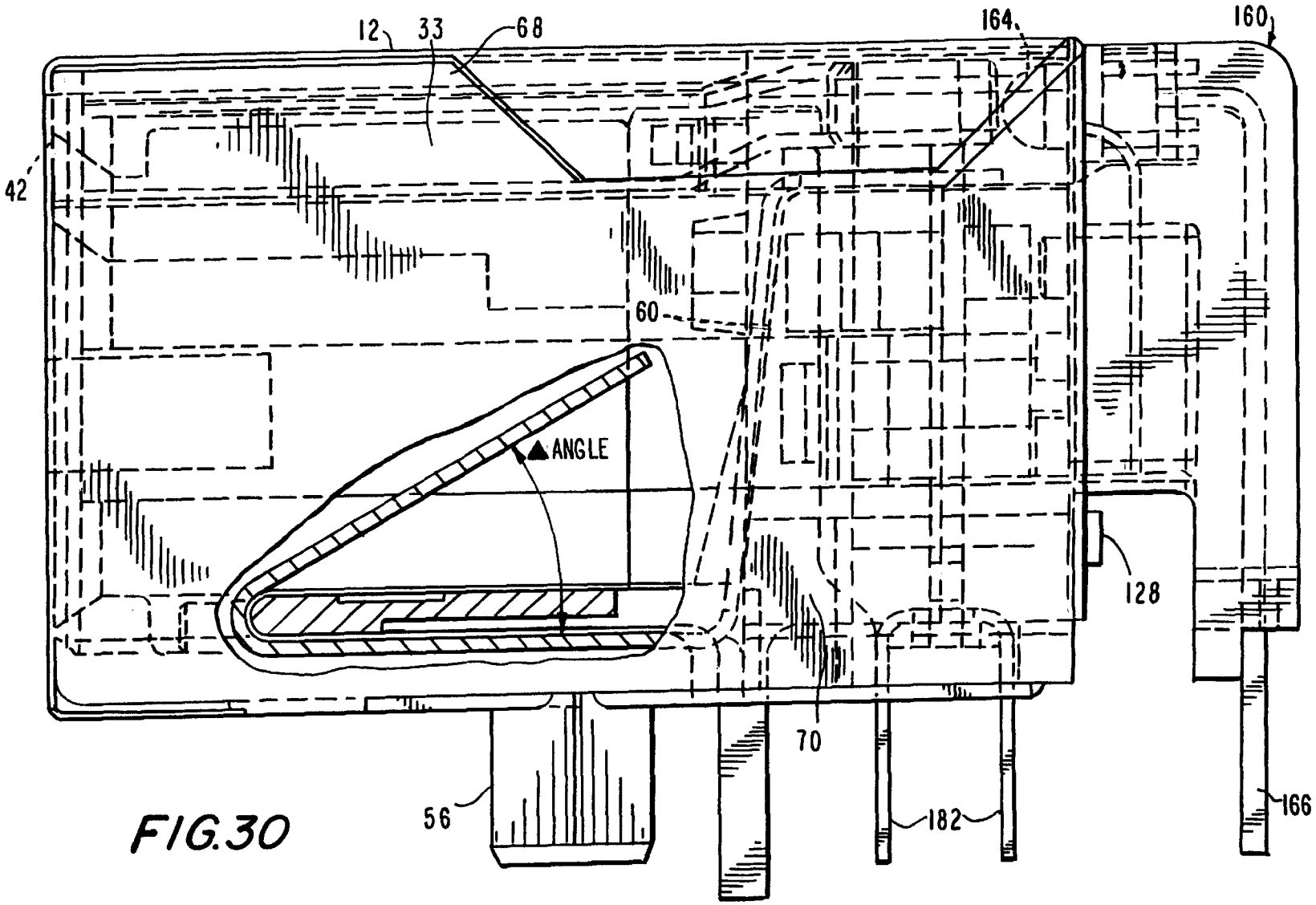
FIG. 30 is a cross-sectional view of the connector assembly shown in FIGS. 4–6 taken along the line 30—30 of FIG. 4.

As shown in FIG. 30, since the length of the light pipe element 30 is slightly less than the length of the top and side walls 72,74 of the outer housing part 68, the LED bulbs 164 lie partially within the enclosure formed by the shield 52 and are close to the rear edge of the light transmitting sections 32. The placement of the LED bulbs 164 within the enclosure formed by the shield 12 would enhance the transmission of the light generated by the LED bulbs 164 through the light transmitting sections 32. If desired, the length of the light pipe element 30 could be made equal to the length of the outer housing part 68 so that the LED bulbs 164 would be entirely outside of the enclosure formed by the shield.

In use, when an electrical circuit is completed through the contact members 60 in the connector assembly 48, the LED bulbs 164 light up. The light generated by the LED bulbs 164 will be transmitted through the light transmitting sections 32 of the light pipe element 30 and thereby be visible from the front face of the connector assembly 48. The connector assembly 48 thus provides a visual indication of the status of the connection between the same and a mating plug, i.e., whether electrical connection has been established or not.

Advantages of the placement of the LED assemblies 162 apart from the jack 50 include the absence of a size limitation on the LED bulbs 164 as well as the avoidance of any possibly adverse affects on the jack housing and contact members caused by heat and/or noise generated by the LED bulbs.

In other embodiments of through-hole-mountable connector assemblies in accordance with the invention, the light pipe element 30 and LED holder 160 are not utilized. That is, the connector assembly may be constructed only with the filtering unit 180.

Figure 31:
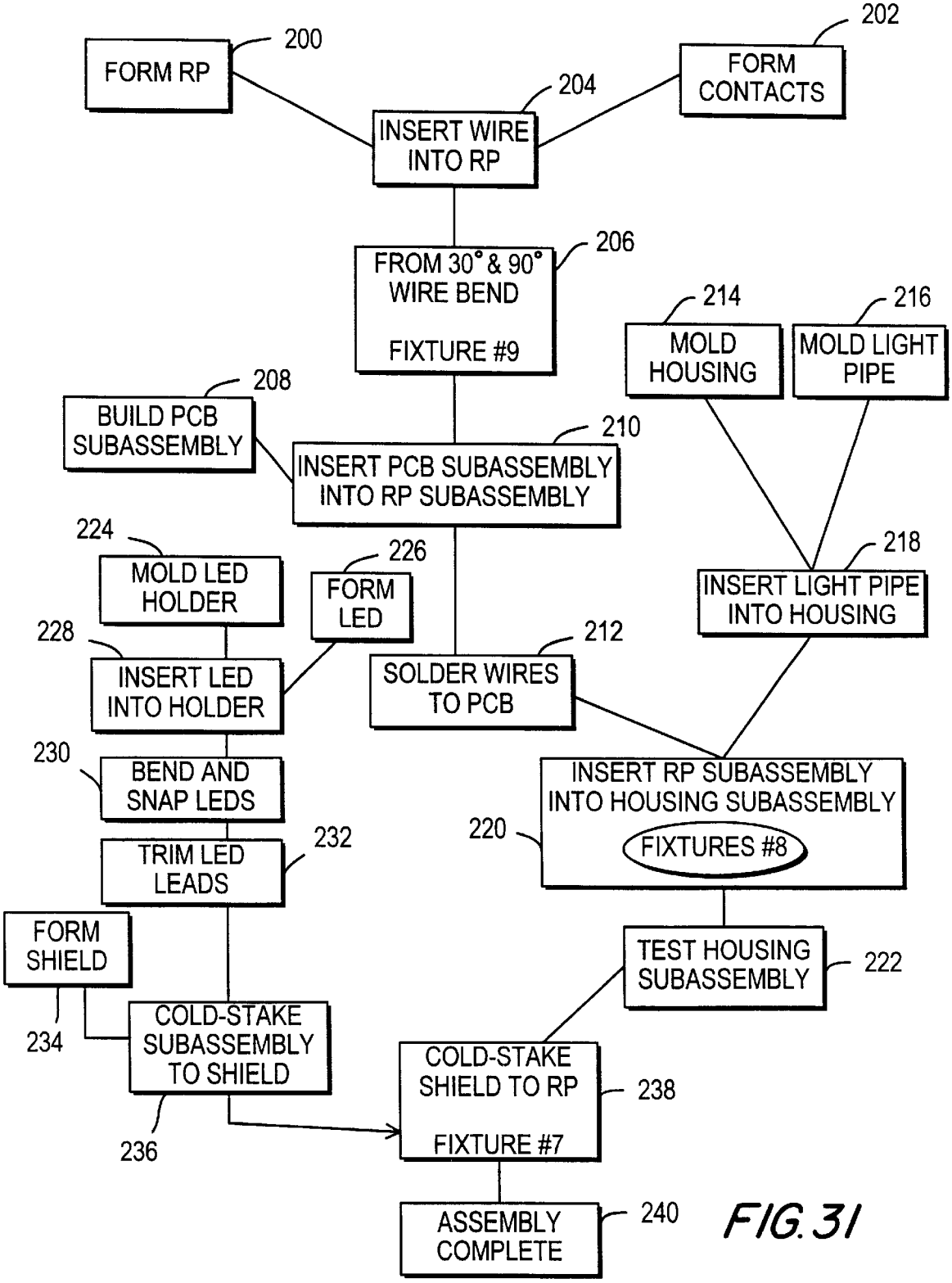
FIG. 31 is a flow chart of one non-limiting process for manufacturing the connector assembly shown in FIGS. 4–6.
Figure 34:
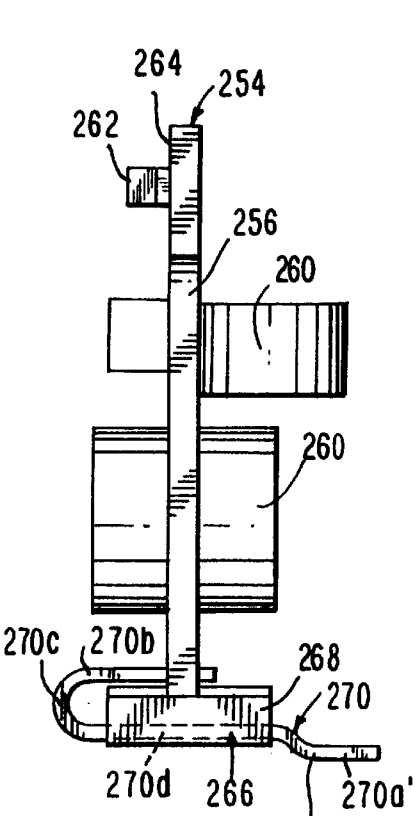
FIG. 34 is a side view of the filtering unit shown in FIG. 33.

FIG. 31 is a flow chart for one possible method for manufacturing the modular connector assembly shown in FIGS. 4–6 and including the light pipe element 30, LED holder 160 and filtering unit 180 described above (in the flow chart RP designating the inner housing part 70). In this manufacturing process, the inner housing part 70 and contact members 60 are formed (steps 200,202) and the contact members 60 are inserted into the inner housing part 70 (step 204). The contact members 60 are bent to form the contact portion 60*a*, intermediate portion 60*c* and board portion 60*b* (step 206). The filtering component 180 is constructed separately (step 208) and inserted into the cavity in the rear portion 101 of the inner housing part 70 such that the terminal pins 182 of the filtering component 180 extend through apertures 126 (step 210). The contact members 60 are then soldered to the filtering component (step 212). Separately, the outer housing part 68 and light pipe element 30 are fabricated (steps 214,216, respectively) and the light pipe element 30 is inserted into the outer housing part 68 (step 218). The subassembly of the inner housing part 70, filtering component 180 and contact members 60 is then inserted into the outer housing part 68 to form jack 50 and tested (steps 220,222). Separately, the frame 161 of the LED holder 160 is molded and the LED assemblies 162 are formed (steps 224,226, respectively). The LED assemblies 162 are inserted into the frame 161 to form LED holder 160 (step 228) and the contacts 166 of the LED assemblies 162 are snapped into the channels 168 of the frame 161 (step 230). The LED contacts 166 are trimmed (step 232). The shield 52 is formed separately (step 234) and the LED holder 160 is cold staked to the shield 52 (step 236). The shield 52 is then placed over the jack 50 and cold staked to the inner housing part 70 via the staking post 128 (step 238). Assembly of the modular electrical connector assembly including magnetic filtering and visual indicators is then complete (step 240).

Thus, what has been described above are several modular electrical connector assemblies including essentially the same outer housing part and inner housing part. Using the outer and inner housing parts, the connector assembly can be optionally provided with visual indicators and/or a magnetic filtering unit. Moreover, the outer and inner housing parts are designed to enable the construction of a surface-mountable connector assembly as well as a through-hole mountable connector assembly, depending on the construction of the contact members.

The surface-mountable connector assemblies described above did not enable the use of a filtering component. Since there are applications in which a surface-mountable connector assemblies including a filtering component is required, one such connector assembly is described with reference to FIGS. 32–37. The components in this embodiment which are the same as those in the embodiments described above will have the reference numerals.

The surface-mountable connector assembly 250 includes a surface-mountable jack 252 including a filtering/LED component 254, as well as the light pipe element 30 and contact members 60 as described above. The outer housing part 68 is also the same with the possible exception that the channels 96 in the bottom wall 76 (although shown in the illustrated embodiment) may be omitted. However, the inner housing part 258 of jack 252 is different in this embodiment in view of the design of the jack 252 for surface-mounting to a printed circuit board in conjunction with a filtering component. Also, since the LEDs are mounted on the same printed circuit board as the filtering components, an LED holder external to the jack is not required. The LEDs are an optional feature and are not required for a functional jack.

Inner housing part 258 includes a front flat portion 300 and a rear portion 302 including a vertical wall 304 extending perpendicular to and adjacent flat portion 300 and a pair of opposed, rectangular projections 306 extending rearward from edges of the vertical wall 304. Eight guide channels 308 are formed in the front edge of flat portion 300 and eight slots 310 are formed at the rear of flat portion 300 adjacent the vertical wall 304. Also, eight guide channels 312 are formed on a lower surface of flat portion 300, each extending from one of the channels 308 to a respective one of the slots 310. Channels 308, slots 310 and channels 312 are dimensioned to accommodate a contact member 60. Eight guide channels 314 are also formed at the upper edge of vertical wall 304 and are also dimensioned to accommodate a contact member 60. Ridges 316 are formed on the side surfaces of vertical wall 304 to facilitate securing of the inner housing part 258 to the outer housing part 68.

The filtering/LED component 254 includes a circuit board 256, toroids 260 and a pair of LEDs 262 mounted on a front face 264 of the printed circuit board 256 and adapted to be in alignment with the light transmitting sections 32 of the light pipe element 30. The filtering/LED component 254 also includes an insert assembly 266 comprising a dielectric housing 268 and ten (10) surface mount contacts 270 arranged in the housing 268, e.g., insert-molded therein. Power and ground leads for the LEDs 262 are formed on the printed circuit board. Of the ten contacts 270, two are electrically connected to a respective power lead of LEDs 262 and one, ground, is electrically connected to both ground leads of the LEDs 262.

Contacts 270 each include a terminal portion 270*a* extending rearwardly from the housing 268 whereby a rear part 270*a*' of each terminal portion 270*a*, which is adapted to engage a soldering pad on the printed circuit board to which the connector assembly 250 is to be attached, is linear and the rear parts 270*a*' of the terminal portions 270*a* are co-planar. A straight front portion 270*b* of each contact 270 is inserted through a respective hole 272 in the printed circuit board and electrically connected thereto, e.g., by soldering. The particular shape of the contacts 270, i.e., a straight portion 270*b*, a U-bend 270*c* adjacent the straight portion 270*b*, another straight portion 270*d* through the housing 268 and the terminal portion 270*a*, is designed to ensure that the terminal portions 270*a* have the required properties to enable soldering to a printed circuit board. Other shapes of the contacts 270 could also be utilized in accordance with the invention.

For this embodiment, it is an advantage of the separate manufacture of the insert assembly 266 including the contacts 270 that problems arising from attaining co-planarity of terminal portions of contact members when surface mounting a jack to a printed circuit board are substantially avoided. Instead, in the invention, the insert assembly 266 would be manufacture in a manner to ensure co-planarity of the rear parts 270*a*' of the terminal portions 270*a*.

The connector assembly 250 may also include a shield (not shown) arranged around the jack 250 and including mounting tabs for connection to a surface printed circuit board.

Figure 33:
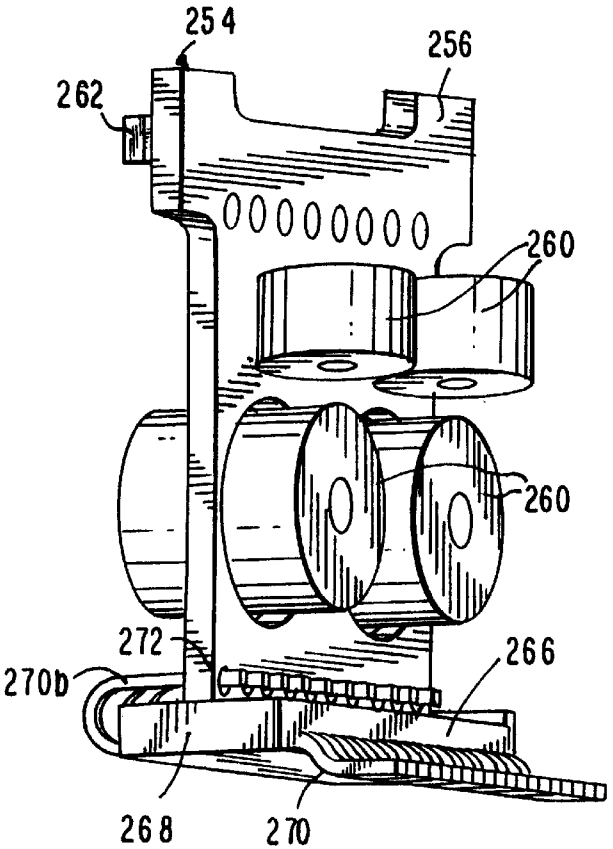
FIG. 33 is a perspective view of a filtering unit for the jack shown in FIG. 32.
Figure 32:
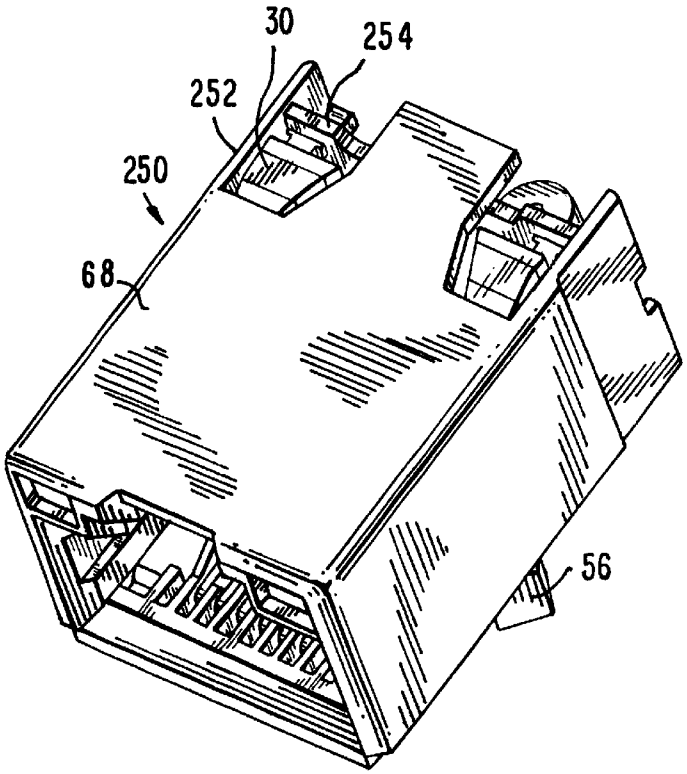
FIG. 32 is a perspective view of another embodiment of a surface-mountable jack in accordance with the invention.
Figure 35:
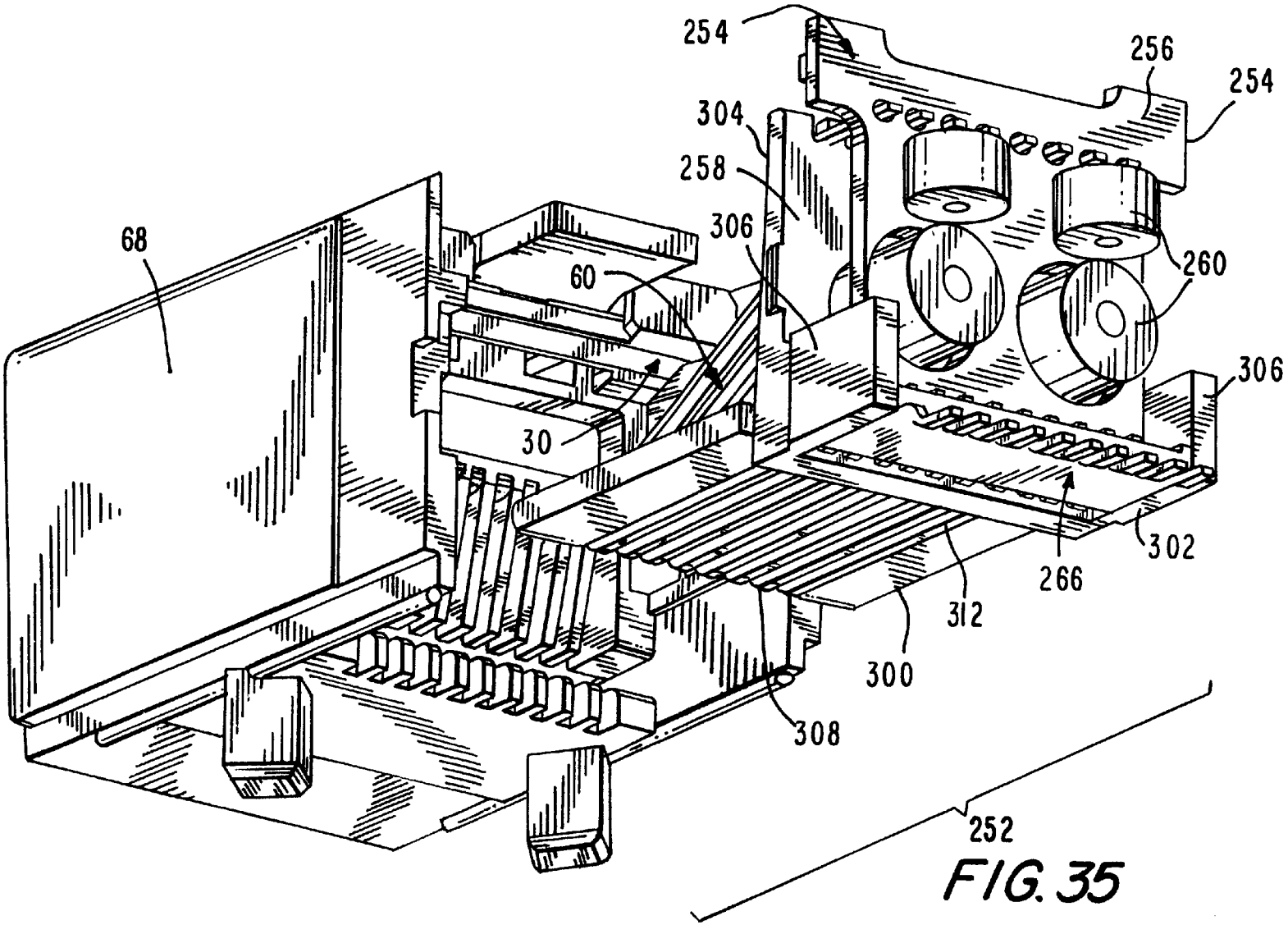
FIG. 35 is an exploded rear perspective view of the jack shown in FIG. 32.
Figure 36:
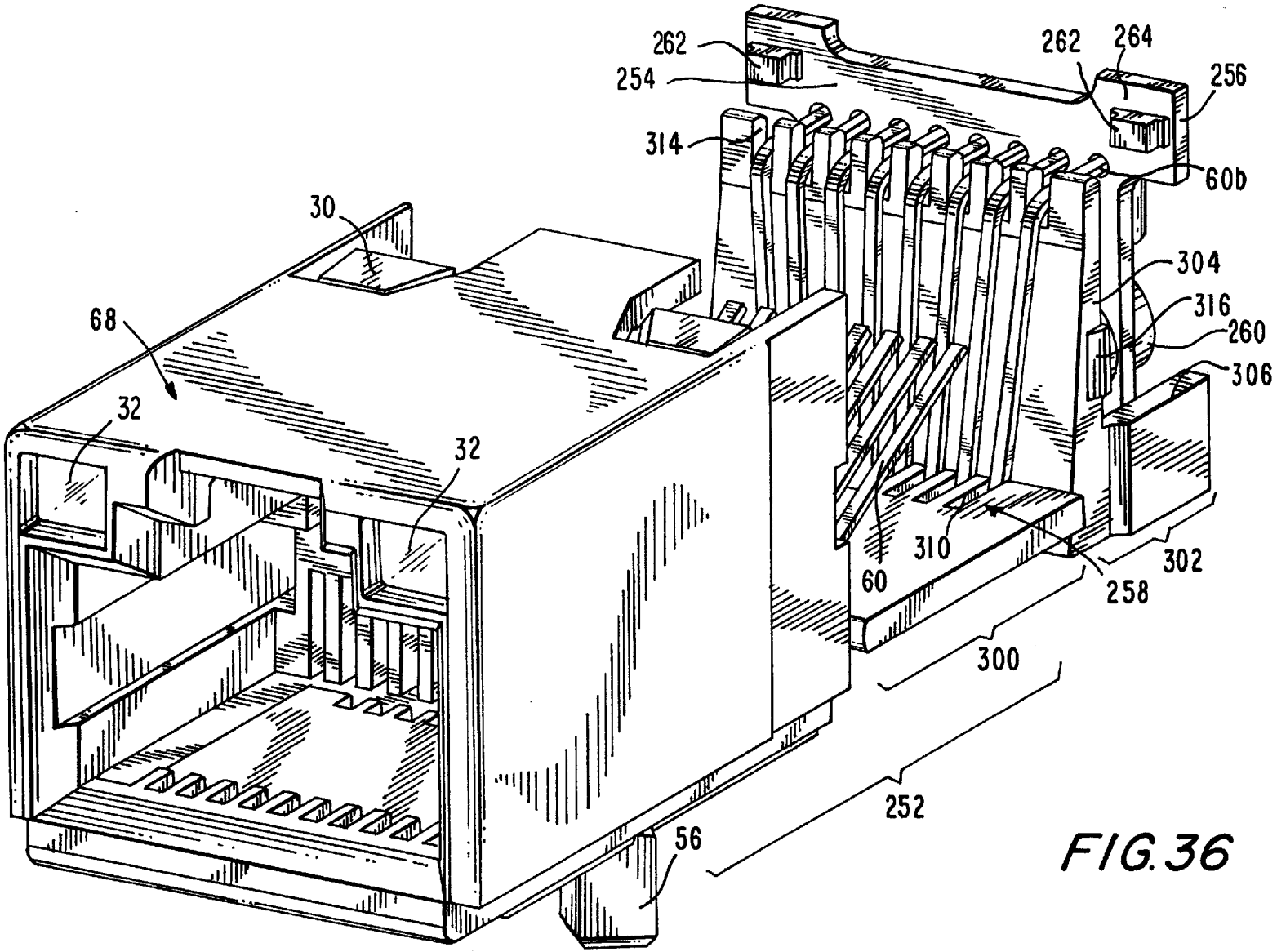
FIG. 36 is an exploded front perspective view of the jack shown in FIG. 32.
Figure 37:
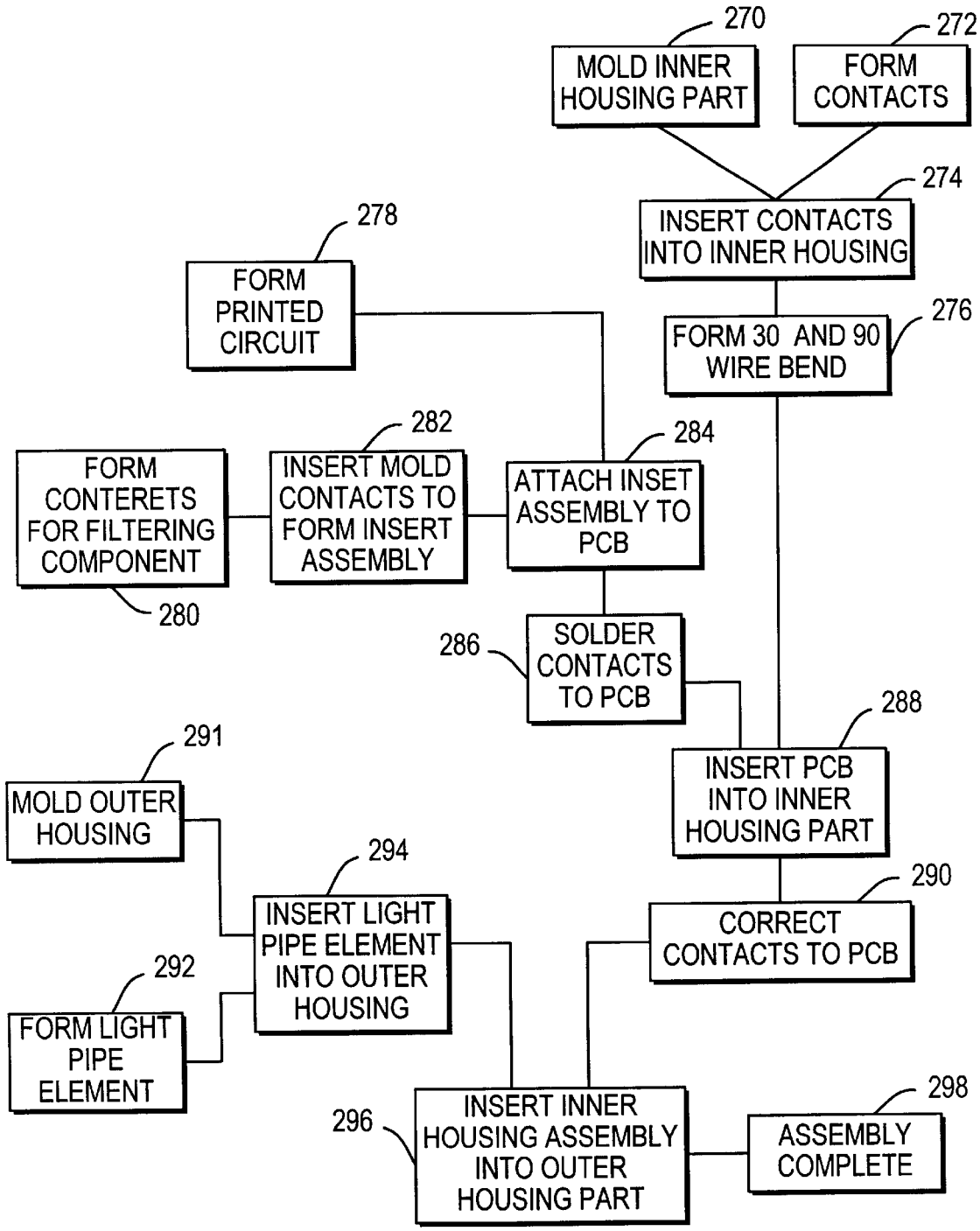
FIG. 37 is a flow chart of one non-limiting process for manufacturing the jack shown in FIGS. 32–36.

FIG. 38 is a flow chart for one possible process for manufacturing the connector assembly 250 including the jack 252, light pipe element 30 and filtering/LED component 254 described above. In this process, the inner housing part 258 and contact members 60 are formed (steps 270,272) and the contact members 60 are inserted into the inner housing part 70 (step 274). The contact members 60 are bent to form the contact portion 60*a*, intermediate portion 60*c* and board portion 60*b* and to pass through channels 308, slots 310 and channels 314 (step 276). The printed circuit board of the filtering/LED component 254 is constructed separately with the toroids and LEDs 262 mounted thereon and a wiring pattern (step 278). Contacts 270 are formed and insert housing 266 is formed by insert molding using contacts 270 (steps 280,282). The insert assembly 266 and filtering/LED component 254 are attached to one another (step 284) and the front portion 270*b* of the contacts 270 is soldered to the printed circuit board (step 286). The subassembly of the filtering/LED component 254 and insert assembly 266 is then inserted into the space between the projections 306 on the inner housing part 258 such that the rear portion 60*b* of the contact members 60 passes through holes at the upper region of the printed circuit board 256 of the filtering/LED component 254 (step 288). The rear portions 60*b* of the contact members 60 are then soldered to the printed circuit board 256 to form a subassembly as shown in FIG. 33 (step 290). Separately, the outer housing part 68 and light pipe element are fabricated (steps 291,292, respectively) and the light pipe element is inserted into the outer housing part 68 (step 294). The subassembly of the inner housing part 258, filtering/LED component 254 and contact members 60 is then inserted into the outer housing part 68 whereby the LEDs 262 align with the light transmitting sections 32 of the light pipe element 30 (step 296). Assembly of the modular electrical connector assembly including magnetic filtering and visual indicators is then complete (step 298). An optional shield may be placed over the jack.

For this embodiment, it is also possible to construct a surface-mountable connector assembly with the filtering component but without the visual indicator. In this case, the LEDs 262 would not be installed on the printed circuit board 256 and the light pipe element 30 would not be inserted into the outer housing part 68.

In an alternative embodiment, instead of mounting LEDs 262 directly on the printed circuit board 256 and transmitting light from the LEDs 262 through the light transmitting sections 32 of the light pipe element 30, LEDs could be arranged adjacent the front face of the outer housing part 68 and leads provided which extend through the outer housing part 68 from the LEDs to the printed circuit board at the rear of the jack.

It is recognized that the placement of LEDs on the same circuit board as the filtering component may require electrical isolation on the printed circuit in view of the electrical noise generated by the LEDs.

FIGS. 38 and 39 show another embodiment of a through-hole-mountable connector assembly in accordance with the invention designated 400. Connector assembly 400 includes a jack 402, a metal shield 404 arranged over the jack 402 and an external LED carrier 406. The jack 402 includes the same outer and inner housing parts 68,70, contact members 60, light pipe element 30 and filtering component 180 described above. Shield 404 includes a rear panel 408 having one or more rearwardly extending mounting posts 410. The LED carrier 406 is a plastic member which includes mating surfaces 412 (FIG. 39) for the mounting posts 410 so that the LED carrier 406 may be securely attached to the shield 404 via mounting posts 410. The LED carrier 406 includes support surfaces 420 to enable a pair of LED assemblies 414 to be mounted in connection therewith. Each LED assembly 414 includes a body or bulb 416 and a pair of contacts 418 leading from the body 416 through the LED carrier 406 to extend beyond the lower surface thereof. LED assemblies 414 may the same as the LED assemblies 162 described above In yet another embodiment of a surface-mountable connector assembly including a visual indicator in accordance with the invention designated 430 in FIG. 40, instead of the LED carrier 406 attached to the shield 404 as in the embodiment shown in FIGS. 38 and 39, a light pipe element 422 is constructed with light transmitting sections 424 which extend beyond the rear surface of the connector assembly 400 to locations above LEDs 426 arranged on the printed circuit board 428 to which the connector assembly 400 is mounted. In this case, the rear panel 408 of the shield 404 includes apertures for allowing passage of the light transmitting sections 424. This arrangement could also be used for a through-hole-mountable connector assembly.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

We claim:

1. A connector assembly (8) for mounting on a main printed circuit board (126), comprising:

a jack (10, 50) defining a plug-receiving receptacle (16) and including an outer housing part (68) and an inner housing part (70);

circuit coupling means including contact portions (18*a* ) arranged in said receptacle (16) and adapted to engage contacts of a mating plug when situated in said receptacle and terminal portions (18*b*) adapted to engage the main printed circuit board (126) and being electrically coupled to said contact portions (18*a*);

a light pipe element (30) arranged in said jack (10) and comprising at least one light transmitting section (32) arranged such that said at least one light transmitting section (32) is visible from a front face (82) of said jack (10); and light generating means (164) for generating light, said light generating means (164) being arranged such that light generated by said light generating means (164) is transmitted through said at least one light transmitting section (32) to said front face (82) of said jack (10);

an internal printed circuit board (183) arranged in said jack (10);

a first set of contacts (60) arranged in said jack (10) including said contact portions (18*a*) arranged in said receptacle (16) and being connected to said internal printed circuit board (183), wherein said outer housing part (68) comprises a top wall (72), opposed side walls (74), a bottom wall (76) and a comb portion (90) defining a plurality of slots for receiving ends of said contacts (60), said top and side walls (72 and 74) having a length greater than a length of said bottom wall (76) to thereby define a cavity (78) at a rear of said outer housing part (68) rearward of said comb portion (90), said inner housing part (70) comprising a front flat portion (98), a vertical wall (100) extending perpendicular to and upwards from said front portion (98) and a rear portion (101) extending rearwardly from a lower portion of said vertical wall (100) and defining a second cavity, said vertical wall (100) and rear portion (101) being situated in said cavity (78); and a second set of contacts (182) connected to said internal printed circuit board (183) and including said terminal portions (18*b*) adapted to engage the main printed circuit board (126), said internal printed circuit board (183) including a wiring pattern for electrically coupling said first set of contacts (60) and said second set of contacts (182);

said front portion (98) of said inner housing part (70) including channels (104) at a front edge, channels (108) in a lower surface and slots (106) extending from said lower surface to an upper surface alongside said vertical wall;

said vertical wall (100) of said inner housing part (70) including channels at an upper edge;

whereby said first set of contacts (60) pass through said channels (104) at said front edge of said inner housing part (70), through said channels in said lower surface of said inner housing part (70), through said slots (106) in said front portion and through said channels (110) at said upper edge of said vertical wall (100) and connect to said internal printed circuit (183).

2. The connector assembly of claim 1, wherein said top wall (78) of said outer housing part (68) includes a cavity (86) adjacent each of said side walls (74), said at least one light transmitting section (32) comprising two light transmitting sections, each of said light transmitting sections (32) having a greater cross-sectional area at a rear of said jack (10) occupying a respective one of said cavities than adjacent said front face (82) of said jack (10).

3. A connector assembly for mounting on a main printed circuit board, comprising a jack (10) defining a plug-receiving receptacle (16) and including an outer housing part (68) and an inner housing part (70), said inner housing part (70) comprising a front flat portion (98), a vertical wall (304) extending perpendicular to said front portion (98) and a rear portion (101) extending rearward from said vertical wall (304), said rear portion (101) comprising a pair of opposed projections (306) extending rearwardly from a lower end of said vertical wall (304) forming a cavity, and circuit coupling means including contact portions (18*a*) arranged in said receptacle (16) and adapted to engage contacts of a mating plug when situated in said receptacle (16) and terminal portions (18*b*) adapted to engage the main printed circuit board (126) and being electrically coupled to said contact portions, said circuit coupling means comprising an internal printed circuit board (183) arranged at least partially between said projections (306) of said rear portion (101) of said inner housing part (70), a first set of contacts (60) arranged in said jack (10) and including said contact portions (18*a*) arranged in said receptacle (16), a second set of contacts (182) connected to said internal printed circuit board (183) and including said terminal portions (18*b*) adapted to engage the main printed circuit board (126), said internal printed circuit board (183) including a wiring pattern for electrically coupling said first set of contacts (60) and said second set of contacts (182), and a light pipe element (30) arranged in said jack (10) and comprising at least one light transmitting section (32) arranged such that said at least one light transmitting section (32) is visible from a front face (82) of said jack (10), and light generating means (164) arranged on said internal printed circuit board (183) for generating light, said light generating means (164) being arranged such that light generated by said light generating means (164) is transmitted through said at least one light transmitting section (32) to said front face (82) of said jack (10).

4. The connector assembly of claim 3, further comprising filtering components (180) arranged on said internal printed circuit board (183), said wiring pattern being arranged to electrically couple said first set of contacts (60), said second set of contacts (182) and said filtering components (180).

5. The connector assembly of claim 3, wherein said front portion (98) of said inner housing part (70) includes channels (104) at a front edge, channels (108) in a lower surface and slots (106) extending from said lower surface to an upper surface alongside said vertical wall, said vertical wall of said inner housing part including channels at an upper edge, said first set of contacts being arranged to pass through said channels at said front edge of said inner housing part (70), through said channels in said lower surface of said inner housing part (70), through said slots (106) in said front portion and through said channels (110) at said upper edge of said vertical wall and connect to said internal printed circuit board (183).

6. The connector assembly of claim 3, further comprising an insert assembly (266) connected to said internal printed circuit board (183), said insert assembly (266) including said second set of contacts (182), said contacts in said second set of contacts (182) including a board portion (256) connected to said internal printed circuit board (183), said terminal portion (270*a*) of said contacts in said second set of contacts (182) being adapted to be surface-mounted to the main printed circuit board (126).

7. The connector assembly of claim 3, wherein said light generating means comprise at least one LED (164) arranged in alignment with a respective one of said at least one light transmitting section (32) of said light pipe element (30), said wiring pattern in said internal printed circuit board (183) being arranged to electrically couple said at least one LED (164) to at least two of said contacts (270) in said second set of contacts (182).

* * * * *